US011585643B2

(12) United States Patent
Johnson et al.

(10) Patent No.: US 11,585,643 B2
(45) Date of Patent: Feb. 21, 2023

(54) SYSTEMS, APPARATUSES, DEVICES, AND METHODS FOR INITIATING OR DETONATING TERTIARY EXPLOSIVE MEDIA BY WAY OF PHOTONIC ENERGY

(71) Applicant: ORICA INTERNATIONAL PTE LTD, Singapore (SG)

(72) Inventors: David Olaf Johnson, Aurora, CO (US); Rodney Wayne Appleby, Shailer Park (AU); Richard John Goodridge, Redhead (AU); Ming Chung Lee, Highlands Ranch, CO (US); Francisco Sanchez, Aurora, CO (US); Matthew Tolliver Rawls, Aurora, CO (US)

(73) Assignee: ORICA INTERNATIONAL PTE LTD, Singapore (SG)

( * ) Notice: Subject to any disclaimer, the term of this patent is extended or adjusted under 35 U.S.C. 154(b) by 63 days.

(21) Appl. No.: 16/978,347

(22) PCT Filed: Mar. 8, 2019

(86) PCT No.: PCT/US2019/021280
§ 371 (c)(1),
(2) Date: Sep. 4, 2020

(87) PCT Pub. No.: WO2019/190717
PCT Pub. Date: Oct. 3, 2019

(65) Prior Publication Data

US 2021/0003371 A1 Jan. 7, 2021

Related U.S. Application Data

(60) Provisional application No. 62/640,334, filed on Mar. 8, 2018.

(51) Int. Cl.
*F42B 3/113* (2006.01)
*F42D 1/04* (2006.01)

(52) U.S. Cl.
CPC ..... *F42B 3/113* (2013.01); *F42D 1/04* (2013.01)

(58) Field of Classification Search
CPC ..... F42B 3/10; F42B 3/113
See application file for complete search history.

(56) References Cited

U.S. PATENT DOCUMENTS 3,408,937 A 11/1968 Lewis
4,343,242 A * 8/1982 Welk ..... G02B 6/4417 218/154

(Continued)

FOREIGN PATENT DOCUMENTS

| | | |
|---|---|---|
| EP | 1443297 A1 | 8/2004 |
| WO | 2006058349 | 6/2006 |
| WO | 2017035594 | 3/2017 |

OTHER PUBLICATIONS

International Search Report and Written Opinion for PCT/US2019/021280 dated Oct. 25, 2019.

(Continued)

*Primary Examiner* — Joshua T Semick
(74) *Attorney, Agent, or Firm* — Barnes & Thornburg LLP

(57) ABSTRACT

In an embodiment, a photoinitiation apparatus includes: a set of illumination sources or elements configured for outputting optical energy; a body structure having a proximal body structure portion confining a proximal volume of explosive medium, an intermediate body structure portion confining an intermediate volume of explosive medium, and a distal body structure portion confining a distal volume of explosive medium, wherein the proximal volume of explosive medium is optically coupled to portions of the first volume of explosive medium, at least one of the proximal volume of explosive medium and the distal volume of explosive medium is a tertiary explosive medium, and (a) the body (Continued)

structure does not carry a primary explosive composition and does not carry a secondary explosive composition, and/or (b) each of the proximal, intermediate, and distal volumes of explosive media has an initiation sensitivity that is less than cyclotrimethylenetrinitramine (RDX) based explosive compositions.

6 Claims, 21 Drawing Sheets

(56) References Cited

U.S. PATENT DOCUMENTS

| | | | | |
|---|---|---|---|---|
| 4,860,653 | A | 8/1989 | Abouay | |
| 5,179,247 | A | 1/1993 | Hawley | |
| 5,472,529 | A | 12/1995 | Arita | |
| 7,793,592 | B2 * | 9/2010 | Hofmann | F42B 3/13 102/530 |
| 8,272,325 | B2 * | 9/2012 | Goodridge | F42D 1/043 102/215 |
| 9,706,755 | B2 | 7/2017 | Furton | |
| 11,131,530 | B2 * | 9/2021 | Wilkins | F42B 3/113 |
| 2003/0015112 | A1 | 1/2003 | Gavrilovic | |
| 2010/0180786 | A1 | 7/2010 | Goodridge | |
| 2013/0098257 | A1 | 4/2013 | Goodridge | |
| 2016/0031767 | A1 | 2/2016 | Chavez | |
| 2017/0074625 | A1 | 3/2017 | Appleby | |
| 2017/0113941 | A1 | 4/2017 | Batllo | |
| 2017/0198560 | A1 | 7/2017 | Mace et al. | |

OTHER PUBLICATIONS

Extended European Search Report for European App. No. 19774793.4 dated Jan. 16, 2022, 10 pages.

Chilean Notice of Opposition for Chilean App. No. 2020-002308 dated May 17, 2021, 42 pages, English translation included.

Peruvian Notice of Opposition dated Mar. 8, 2021, 14 pages, English translation included.

The MSDS Hyper-Glossary: Explosive, available from http://www.ilpi.com/msds/ref/explosive.html, at least available on Oct. 7, 2022, 3 pages.

Sabatini et al. , "Recent Advances in the Synthesis of High Explosive Materials" Crystals, 2016, 6(1), 5, available at https://www.mdpi.com/2073-4352/6/1/5/htm, 42 pages.

ChEBI: 63490—explosive, available from https://www.mdpi.com/2073-4352/6/1/5/htm, available at least on Oct. 7, 2022, 3 pages.

Special Writ filed by Opponent in Chile for counterpart Chiliean Patent App. No. 202002308 dated Mar. 11, 2022, 11 pages, English translation included.

* cited by examiner 195
290
110
190
212
215
210
100a
195
140
142
130
132
120
122a
220
228
190
214
212
215
230
290
$L_D$
$L_I$
$L_P$

SYSTEMS, APPARATUSES, DEVICES, AND METHODS FOR INITIATING OR DETONATING TERTIARY EXPLOSIVE MEDIA BY WAY OF PHOTONIC ENERGY

CROSS REFERENCE TO RELATED APPLICATIONS

This application is a U.S. national stage application under 35 U.S.C. § 371(b) of International Application No. PCT/US2019/021280 filed Mar. 8, 2019, which claims priority to U.S. Provisional Patent Application No. 62/640,334 filed on Mar. 8, 2018, the disclosures of both of which are hereby expressly incorporated by reference in their entirety.

TECHNICAL FIELD

The present invention relates in general to systems, apparatuses, devices and methods for initiating or detonating tertiary explosives media, and in particular initiating or detonating tertiary explosives media by way of photonic energy.

BACKGROUND

Commercial blasting operations, e.g., performed as part of mineral mining, quarrying, civil tunneling, civil demolition, geophysical formation characterization, seismic exploration, and/or hydrocarbon energy source or fuel production or extraction activities, have become progressively safer over time as a result of technological innovation. For instance, nitroglycerine, which was invented in 1847, is in its pure form extremely sensitive to explosive initiation in response to physical shock/impact, friction, and heat; and nitroglycerine degrades over time to even more unstable forms, rendering pure nitroglycerin highly dangerous to transport or use. The widespread use of pure nitroglycerine in early commercial blasting operations was limited due to safety concerns.

Alfred Nobel subsequently developed a small wooden detonator with a black powder charge, that was placed in a metal canister containing nitroglycerin. When the detonator was lit, its explosion caused the detonation of the nitroglycerin. In 1865, he further invented the blasting cap, which replaced the wooden detonator. The invention of the blasting cap inaugurated the modern use of high explosives in commercial blasting operations. Alfred Nobel further developed dynamite, which combined nitroglycerine with diatomaceous earth as an inert absorbent, in 1867. Dynamite found widespread use in early commercial blasting operations due to its safety relative to nitroglycerine. Notwithstanding, accidents involving dynamite were not uncommon.

In general, different types of explosives can be categorized as primary explosives, secondary explosives, or tertiary explosives depending upon their sensitivity to initiation by way of physical shock/impact, friction, and heat. A primary explosive is typically much more sensitive to initiation than a secondary explosive, which is typically much more sensitive to initiation than a tertiary explosive.

Further innovations led to the development of significantly safer and easier to handle explosives, which have demonstrated their utility in large-scale commercial blasting operations, particularly mining. Such explosives include binary, water gel, slurry, and emulsion explosives, among which multiple tertiary explosive compositions have been developed, which offer enhanced safety.

Notwithstanding, the initiation and detonation of such significantly safer and easier to handle explosives, including tertiary explosives, conventionally requires the use of (i) a detonator that contains a small amount of a highly sensitive explosive, commonly referred to as a primary explosive; and commonly (ii) a booster that contains a secondary explosive. More specifically, a conventional explosive initiation chain or train used to initiate and detonate a large volume of tertiary explosive material includes a small or very small volume of highly sensitive, easily initiated primary explosive carried by a detonator, which is inserted or positioned in a booster that carries a larger volume of secondary explosive material. The booster is initiated in response to detonation of the detonator. The booster is disposed in contact with portions of the large volume of tertiary explosive material, and detonation of the booster causes detonation of the large volume of tertiary explosive material.

In order to enhance or maximize the safety of commercial blasting operations, it is desirable to reduce or minimize, and eliminate if possible, the presence of primary explosives and ideally even secondary explosives from explosives initiation chains. The application of optical energy, e.g., laser energy, to explosive materials offers the possibility of progressing toward this objective.

Unfortunately, prior efforts directed to producing optical initiation systems, apparatuses, devices, and techniques have not yielded results that offer a significantly improved safety profile, or which suffer from drawbacks such as efficacy and/or reliability problems and/or cost disadvantages in the context of commercial blasting operations, e.g., large scale commercial blasting operations. A need therefore exists for further improved optical initiation systems, apparatuses, devices, and techniques.

SUMMARY

In accordance with an aspect of the present disclosure, a photoinitiation apparatus, configured for photoinitiating an explosive medium carried thereby, includes: a set of illumination sources or elements configured for outputting electromagnetic energy having at least one wavelength within or between ultraviolet (UV) and infrared (IR) portions of the electromagnetic spectrum; and a body structure or shell structure confining at least one volume of tertiary explosive medium, wherein a portion of the at least one volume of tertiary explosive medium are photonically coupled to the set of illumination sources or elements, wherein the photoinitation apparatus excludes each of a primary explosive composition and a secondary explosive composition.

The at least one volume of tertiary explosive medium can contain a photothermal absorber or a photoexcitation transfer agent. The photothermal absorber can include bitumen, crude oil, gilsonite, bunker oil, coal dust, or metal nanoparticles, and/or another type of phothermal absorbing substance, material, composition, or structure.

In accordance with an aspect of the present disclosure, a photoinitiation apparatus, configured for photoinitiating an explosive medium carried thereby, includes: a set of illumination sources or elements configured for outputting electromagnetic energy having at least one wavelength within or between ultraviolet (UV) and infrared (IR) portions of the electromagnetic spectrum; and a body structure or shell structure confining at least one volume of explosive medium including at least one volume of tertiary explosive medium, wherein a portion of the at least one volume of tertiary explosive medium is photonically coupled to the set of illumination sources or elements, wherein the photoinitation apparatus excludes a primary explosive composition, and wherein each of the at least one volume of explosive media within the body or shell structure has an initiation sensitivity that is less than cyclotrimethylenetrinitramine (RDX) based explosive compositions.

The at least one volume of tertiary explosive medium can contain one of a photothermal absorber and a photoexcitation transfer agent. The photothermal absorber can include or be bitumen, crude oil, gilsonite, bunker oil, coal dust, or metal nanoparticles, and/or another type of phothermal absorbing substance, material, composition, or structure.

In accordance with an aspect of the present disclosure, a photoinitiation apparatus, configured for photoinitiating an explosive medium carried thereby, includes: a set of illumination sources or elements configured for outputting electromagnetic energy having at least one wavelength within or between ultraviolet (UV) and far infrared (IR) portions of the electromagnetic spectrum, wherein the set of illumination sources includes a laser; and a body structure including a shell, tube, or pipe having a chamber, passage, or lumen therein carrying at least one volume of explosive medium including a volume of tertiary explosive medium, wherein the volume of tertiary explosive medium is photonically coupled to the set of illumination sources, wherein (a) the body structure does not carry a primary explosive composition and does not carry a secondary explosive composition, and/or (b) each of the at least one volume of explosive media has an initiation sensitivity that is less than cyclotrimethylenetrinitramine (RDX) based explosive compositions.

The volume of tertiary explosive composition can carry a photothermal absorber or a photoexcitation transfer agent. The photothermal absorber can include or be bitumen, crude oil, gilsonite, bunker oil, coal dust, or metal nanoparticles, and/or another photothermal absorbing substance, material, composition, or structure.

In accordance with an aspect of the present disclosure, a photoinitiation apparatus, configured for photoinitiating an explosive medium carried thereby, includes: a set of illumination sources or elements configured for outputting electromagnetic energy having at least one wavelength within or between ultraviolet (UV) and far infrared (IR) portions of the electromagnetic spectrum; and a body structure having each of a proximal body structure portion confining a proximal volume of explosive medium, an intermediate body structure portion confining an intermediate volume of explosive medium, and a distal body structure portion confining a distal volume of explosive medium, wherein the proximal volume of explosive medium is photonically coupled the set of illumination sources, wherein at least one of the proximal volume of explosive medium and the distal volume of explosive medium is a tertiary explosive medium, and wherein (a) the body structure does not carry a primary explosive composition and does not carry a secondary explosive composition, and/or (b) each of the proximal, intermediate, and distal volumes of explosive media has an initiation sensitivity that is less than cyclotrimethylenetrinitramine (RDX) based explosive compositions.

Each of the proximal volume of explosive medium and the distal volume of explosive medium can be a tertiary explosive medium.

Each of the proximal volume of explosive medium and the distal volume of explosive medium can include a fuel and an oxidizer salt.

Each of the proximal volume of explosive medium and the distal volume of explosive medium can include or be an ammonium nitrate (AN) based emulsion explosive medium.

The proximal volume of explosive medium can include a photothermal absorber or a photoexcitation transfer agent.

The photothermal absorber can include or be bitumen, crude oil, gilsonite, bunker oil, coal dust, or metal nanoparticles, and/or another photothermally absorbing substance, material, composition, or structure.

The intermediate volume of explosive medium can include or be a liquid explosive medium, a gel-based explosive medium, a binary explosive medium, or a peroxide-based explosive medium.

The intermediate volume of explosive medium can include one of nitromethane, nitroethane, nitropropane, and hydrogen peroxide.

In accordance with an aspect of the present disclosure, a method, for photoinitiating one or more tertiary explosive media contained in a set of boreholes, each borehole including or forming a column having a lumen providing an opening, a length, and a cross sectional area, includes: for each borehole within the set of boreholes, loading the borehole with each of: (a) at least one photoinitiation device, wherein the initiation device contains: at least one volume of explosive medium; and a set of illumination sources or elements configured for outputting illumination and directing said illumination into at least portions of the at least one volume of explosive medium, wherein said illumination has at least one wavelength falling within or between ultraviolet (UV) and infrared (IR) portions of the electromagnetic spectrum; and (b) at least one section of tertiary explosive medium that resides external to each of the at least one photoinitiation devices in the borehole, and which is disposed along at least a portion of the length of the borehole, wherein each borehole within the set of boreholes and each photoinitiation device therein excludes each of a primary explosive and a secondary explosive.

Each initiation device can include a body structure providing a proximal body structure portion, an intermediate body structure portion, and a distal body structure portion; the at least one volume of explosive medium includes a proximal volume of explosive medium contained in the proximal body structure portion, an intermediate volume of explosive medium contained in the intermediate body structure portion, and a distal volume of explosive medium contained in the distal body structure portion; and the set of illumination elements is configured to direct illumination into portions of the proximal volume of explosive medium contained in the proximal body structure portion.

The proximal volume of explosive medium can contain a photoexcitation transfer agent, or a photothermal absorber including bitumen, crude oil, gilsonite, bunker oil, coal dust, or metal nanoparticle and/or another phothermally absorbing substance, material, composition, or structure.

In accordance with an aspect of the present disclosure, a method, for photoinitiating one or more tertiary explosive media contained in a set of boreholes, each borehole includes or is formed as a column having a lumen providing an opening, a length, and a cross sectional area, includes: for each borehole within the set of boreholes, loading the borehole with each of: (a) at least one photoinitiation device, wherein the initiation device contains: at least one volume of explosive medium, wherein each of the at least one volume of explosive media carried by the photoinitiation device has an initiation sensitivity less than cyclotrimethylenetrinitramine (RDX) based explosive compositions; and a set of illumination sources or elements configured for outputting illumination and directing said illumination into at least a portion of the at least one volume of explosive medium, wherein said illumination has at least one wavelength falling within or between deep ultraviolet (UV) and far infrared (IR) portions of the electromagnetic spectrum; and (b) at least one section of tertiary explosive medium that resides external to each of the at least one photoinitiation devices in the borehole, and which is disposed along portions of the length of the borehole, wherein each borehole within the set of boreholes and each photoinitiation device therein excludes a primary explosive.

Each initiation device can include a body structure providing a proximal body structure portion, an intermediate body structure portion, and a distal body structure portion, the at least one volume of explosive medium includes a proximal volume of explosive medium contained in the proximal body structure portion, an intermediate volume of explosive medium contained in the intermediate body structure portion, and a distal volume of explosive medium contained in the distal body structure portion, and the set of illumination elements is configured to direct illumination into portions of the proximal volume of explosive medium contained in the proximal body structure portion.

The proximal volume of explosive medium can contain a photoexcitation transfer agent, or a photothermal absorber including bitumen, crude oil, gilsonite, bunker oil, coal dust, or metal nanoparticles and/or another photothermally absorbing substance, material, composition, or structure.

DETAILED DESCRIPTION

Figure 1:
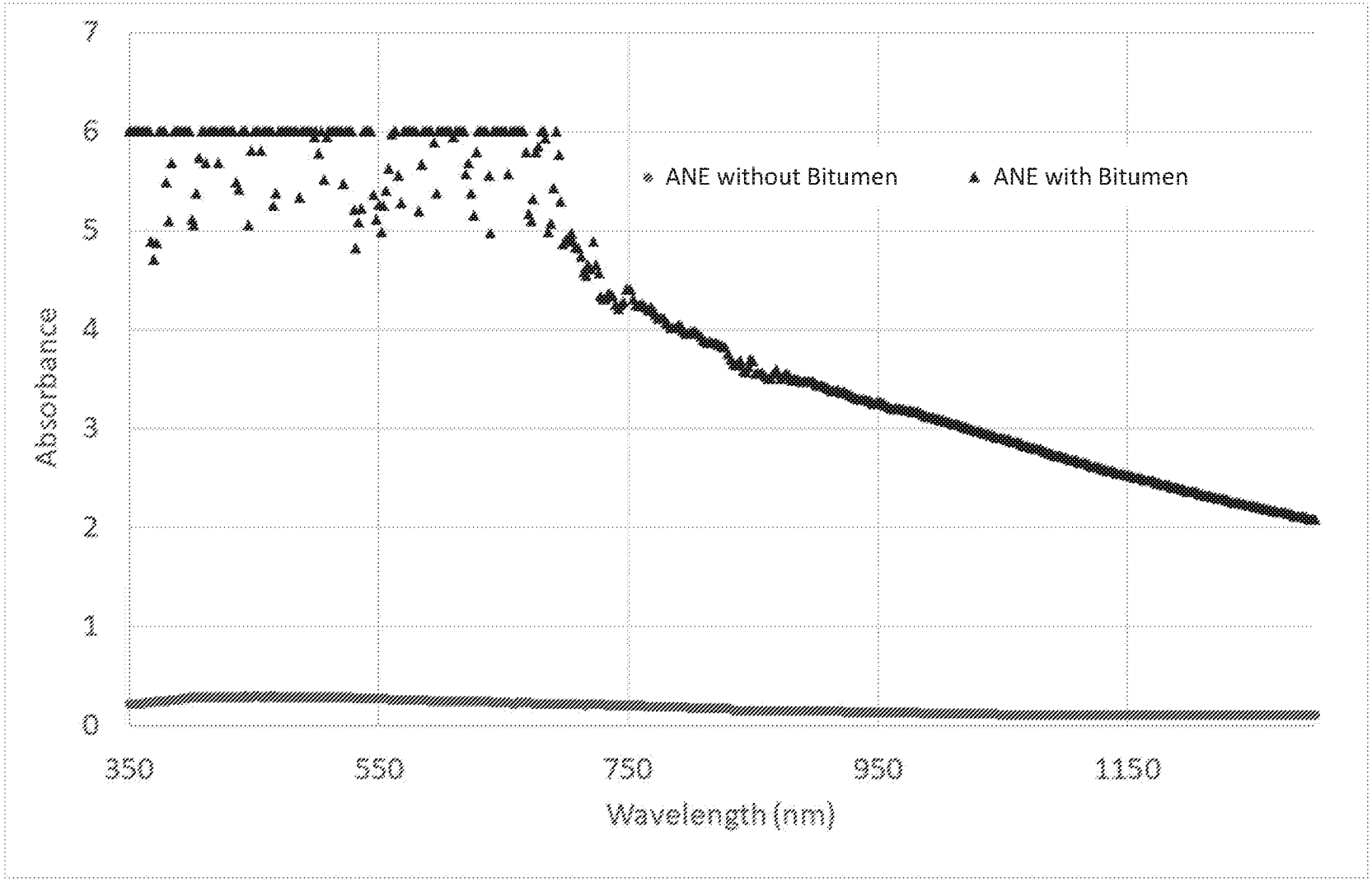
FIG. 1 is a graph showing an optical absorption spectrum of an actual physical sample of a first volume of explosive medium containing bitumen, as well as an analogous version thereof without bitumen, as determined by measurements performed thereon.

Throughout this specification, unless the context stipulates or requires otherwise, any use of word "comprise", and variations such as "comprises" and "comprising", imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that prior publication (or information derived from it) or known matter forms part of the common general knowledge in the field of endeavor to which this specification relates.

As used herein, the term "set" corresponds to or is defined as a non-empty finite organization of elements that mathematically exhibits a cardinality of at least 1 (i.e., a set as defined herein can correspond to a unit, singlet, or single element set, or a multiple element set), in accordance with known mathematical definitions (for instance, in a manner corresponding to that described in An Introduction to Mathematical Reasoning: Numbers, Sets, and Functions, "Chapter 11: Properties of Finite Sets" (e.g., as indicated on p. 140), by Peter J. Eccles, Cambridge University Press (1998)). Thus, a set includes at least one element. In general, an element of a set can include or be one or more portions of a system, an apparatus, a device, a structure, an object, a process, a physical parameter, or a value depending upon the type of set under consideration.

Herein, reference to one or more embodiments, e.g., as various embodiments, many embodiments, several embodiments, multiple embodiments, some embodiments, certain embodiments, particular embodiments, specific embodiments, or a number of embodiments, need not or does not mean or imply all embodiments.

The FIGS. included herewith show aspects of non-limiting representative embodiments in accordance with the present disclosure, and particular structural elements shown in the FIGs. may not be shown to scale or precisely to scale relative to each other. The depiction of a given element or consideration or use of a particular element number in a particular FIG. or a reference thereto in corresponding descriptive material can encompass the same, an equivalent, an analogous, categorically analogous, or similar element or element number identified in another or descriptive material associated therewith. The presence of "/" in a FIG. or text herein is understood to mean "and/or" unless otherwise indicated. The recitation of a particular numerical value or value range herein is understood to include or be a recitation of an approximate numerical value or value range, for instance, within +/−20%, +/−15%, +/−10%, +/−5%, +/−2.5%, +/−2%, +/−1%, +/−0.5%, or +/−0%. The term "essentially all" can indicate a percentage greater than or equal to 90%, for instance, 92.5%, 95%, 97.5%, 99%, or 100%.

The term "initiation" refers to the initiation of combustion in a medium, substance, or composition, and the associated formation of different chemical species, or the initiation of chemical reactions that result in combustion and the associated formation of different chemical species in the medium, substance, or composition.

The term "explosive initiation" refers to initiation giving rise to an explosion, the occurrence of which corresponds to or is defined by at least some of a rapid energy release, volume increase, temperature increase, and gas production or release, as well as the generation of at least a subsonic shock wave.

The term "optical initiation" refers to initiation or explosive initiation by way of the application of optical or electromagnetic energy to a medium, substance, or composition, where such optical or electromagnetic energy exhibits one or more wavelengths, center wavelengths, or bandwidths that fall or approximately fall within a wavelength range between deep ultraviolet (UV) and at least near infrared (IR), e.g., possibly including or extending to mid IR or far IR wavelengths. Such optical initiation can also be referred to or defined herein as photonic initiation.

The term "optically coupled" or "photonically coupled" refers to photonic coupling, or coupling in a manner that enables the communication or transfer and delivery of photons (e.g., corresponding to wavelengths within or between deep ultraviolet (UV) and far infrared (IR) portions of the electromagnetic spectrum) from a first or predetermined location such as an output of a portion of illumination system or element to or into a distinct second or other predetermined location, such as an input of another portion of an illumination system or element or to or into a portion of an explosive medium.

The term "explosive composition" refers to a material or substance that carries, contains, or is a chemical composition capable of undergoing initiation and producing an explosion in association with the release of its own internal chemical energy, such as through initiation and corresponding deflagration that generates an explosion. An explosive composition of appropriate type and/or under appropriate physical conditions may further undergo a deflagration to detonation transition (DDT), which can lead to detonation of the explosive composition, in a manner readily understood by individuals possessing ordinary skill in the relevant art.

The term "explosive medium" or "explosive composition medium" refers to a medium or substance that carries or includes an explosive composition. A given type of explosive medium can be defined as an explosive medium that carries a particular type of explosive composition, e.g., an ammonium nitrate (AN) based emulsion explosive medium can be defined as an explosive medium that carries an AN based emulsion explosive.

The term "detonation" refers to the generation of a supersonic detonation wave or shock front in an explosive medium (e.g., by way of a deflagration to detonation transition, in a manner understood by individuals having ordinary skill in the relevant art).

The term "primary explosive" refers to a chemical composition or medium that is highly or very highly sensitive to explosion or detonation, or which is readily or highly explosive or detonable by way of flame, spark, impact, or other means, whether confined or unconfined. A non-exhaustive partial list of certain representative primary explosives includes nitroglycerin, mercury fulminate, lead azide, lead styphnate, lead picrate, hexamethylene triperoxide diamine (HMTD), and diazodinitrophenol (DDNP).

The term "secondary explosive" refers to a chemical composition or medium having an initiation sensitivity that is less than that of a primary explosive, and which requires or typically requires another or an external shock or impact source, such as a conventional detonator, in order for explosion or detonation of the secondary explosive to occur. A non-exhaustive partial list of certain representative secondary explosives includes dynamite, trinitrotoluene (TNT), pentaerythritol tetranitrate (PETN), cyclotrimethylenetrinitramine (RDX), tetrahexamine tetranitramine (HMX), and ethylene glycol dinitrate (EGDN).

The term "tertiary explosive" refers to a chemical composition or medium having an initiation sensitivity that is less than that of a secondary explosive, and which conventionally would require the explosion or detonation of a primary explosive and/or a secondary explosive in order for explosion or detonation of the tertiary explosive to occur. The term "tertiary explosive" encompasses blasting agents, which in accordance with U.S. Occupational Safety and Health Administration (OSHA) standard 1910.109(a)(1) is defined as any material or mixture, consisting of a fuel and oxidizer, intended for blasting, not otherwise classified as an explosive and in which none of the ingredients are classified as an explosive, provided that the finished product, as mixed and packaged for use or shipment, cannot be detonated by means of a No. 8 test blasting cap when unconfined. The term "tertiary explosive" encompasses various types of emulsion explosives, e.g., AN based emulsion explosives, in a manner readily understood by individuals having ordinary skill in the relevant art. Moreover, the term "tertiary explosive" encompasses media or compositions that fall within the scope of United Nations (UN) Hazard Class Numbers 0331 1.5D and 0332 1.5D relating to UN Numbers assigned by the UN Committee of Experts on the Transport of Dangerous Goods, wherein UN Numbers 0331 1.5D and 0332 1.5D are defined as: UN 0331 1.5D Explosive, blasting, type B or Agent, blasting, Type B; and UN 0332 1.5D Explosive, blasting, type E or Agent, blasting Type E. Such media or compositions fall within U.S. Code of Federal Regulations (C.F.R) Title 49, § 173.50, Division 1.5—very insensitive explosives; substances which have a mass explosion hazard but are so insensitive that there is very little probability of initiation or of transition from burning to detonation under normal conditions of transport. The term "tertiary explosive" can refer to chemical compositions having initiation sensitivity greater than that defined by UN Numbers 0331 1.5D and 0331 1.5E, and/or chemical compositions having initiation sensitivity greater than that defined by U.S. C.F.R. Title 49, § 173.50, Division 1.5. A non-exhaustive partial list of certain representative tertiary explosives includes Ammonium nitrate (AN), ammonium nitrate fuel oil (ANFO), and ammonium nitrate emulsion (ANE).

The term "tertiary explosive medium" refers to a medium or substance that carries a tertiary explosive.

The term "liquid explosive" refers to a chemical composition or medium in liquid or fluid form, and which carries an explosive composition.

The term "gel explosive," "gelled explosive," or "gel based explosive" refers to a chemical composition or medium that exists in gel or gelled form, and which carries an explosive composition.

The term "binary explosive" refers to a chemical composition or medium that (a) is formed by way of combining two chemical constituents, components, or agents that are individually non-explosive prior to their combination, and which (b) becomes explosive upon combination of such individually non-explosive chemical constituents, components, or agents. A binary explosive can be formed of a liquid fuel and an oxidizer, e.g., an oxidizer salt.

Overview

Aspects of the present disclosure are directed to systems, apparatuses, devices, and techniques for explosively initiating or detonating a first volume of explosive medium, and further possibly detonating at least a second volume explosive medium, by way of applying or delivering photons (e.g., having wavelengths or center wavelengths that fall between the deep ultraviolet (UV) and far infrared (IR) portions of the electromagnetic spectrum) to portions of the first volume of explosive medium, where such explosive initiation or detonation occurs without requiring or in the complete absence of any coupling or communication of a combustion front or shock wave that originated outside or independent of the first volume of explosive medium prior to its photonic initiation.

Multiple embodiments in accordance with the present disclosure are directed to systems, apparatuses, devices, and techniques for (a) initiating a first or proximal predetermined, given, specific, volume, or target volume of an explosive composition or medium containing a fuel or fuel phase (e.g., an organic fuel or fuel phase) and an oxidizer salt (e.g., an inorganic oxidizer salt or an organic oxidizer salt) by way of applying or delivering optical, electromagnetic, or photonic energy into portions of the first volume of explosive medium; and possibly (b) optically, electromagnetically, or photonically facilitating, triggering, inducing, or causing a deflagration to detonation transition (DDT) in or detonation of the first or proximal volume of explosive medium and/or an additional volume of explosive medium, e.g., at least a second or distal predetermined, given, specific, volume, or target volume of an explosive composition or medium containing a fuel or fuel phase (e.g., an organic fuel or fuel phase) and an oxidizer salt (e.g., an inorganic oxidizer salt or an organic oxidizer salt), without requiring or in the complete absence of any coupling or communication of a combustion front or shock wave that originated outside or independent of the first volume of explosive medium prior to the optical, electromagnetic, or photonic initiation thereof, where (i) neither the first volume of explosive medium nor the second volume of explosive medium is a primary explosive, (ii) neither the first volume of explosive medium nor the second volume of explosive medium is a secondary explosive, and (iii) an explosives initiation chain, of which the first volume of explosive medium and the second volume of explosive medium are parts, excludes each of a primary explosive and a secondary explosive, and hence no primary explosive composition needs to be or is present in the explosives initiation chain, and no secondary explosive medium or composition needs to be or is present in the explosives initiation chain.

In various embodiments, the first volume of explosive medium can be defined as a volume of explosive medium that is explosively initiated or detonated by way of the application of optical or electromagnetic energy or photons thereto. In embodiments that include a second volume of explosive medium, the second volume of explosive medium can be defined as another distinct volume of explosive medium in which a DDT or detonation occurs subsequent to and as a consequence of the optically-induced explosive initiation of the first volume of explosive medium. The first volume of explosive medium is disposed over a spatial extent (e.g., relative to a length, height, and/or width thereof) that does not completely overlap with a spatial extent of the second volume of explosive medium. For instance, the first volume of explosive medium and the second volume of explosive medium can be completely physically or spatially separated or segregated from each other in several embodiments. At least portions of the first or proximal volume of explosive medium are thus proximal or more proximal to the optical energy delivered thereto than the second or distal volume of explosive medium. Portions of the first or proximal volume of explosive medium can be disposed within a proximal portion or section of a defines that provides a confinement structure, and portions of the second or distal volume of explosive medium can be disposed within a distal portion or section of the confinement structure; and portions of the first or proximal volume of explosive medium can thus be disposed more proximal to an optical energy source or element that delivers optical energy therein than the second or distal volume of explosive medium.

Notwithstanding, some embodiments include only the first volume of explosive medium, e.g., which is continuously disposed within or along portions of a cavity, passage, or lumen internal to a photoinitiation device, and which is photoinitiationed or photodetonated by way of the application of optical, electromagnetic, or photonic energy into portions thereof.

Optical or electromagnetic energy or photons can be directed or applied to or into portions of the first volume of explosive medium by way of a set of illumination sources and/or elements, which depending upon embodiment details can include one or more active photonic devices such as a laser (e.g., a set of semiconductor diode lasers, or another type of laser such as a Nd:YAG excimer laser), a set of LEDs, and a flash or strobe illuminator (e.g., a flash lamp, or a plurality of LEDs configured for high intensity flash or strobe illumination), and one or more passive optical or photonic devices, elements, or structures such as a set of optical fibers, fibre bundles, light guides, and/or lenses configured for outputting photons corresponding to one or more of the foregoing active photonic devices. The set of illumination sources and/or elements is configured for outputting optical or electromagnetic energy or radiation having one or more wavelengths, a power level and intensity, and possibly pulse characteristics suitable for optically, electromagnetically, or photonically initiating the first volume of explosive medium, e.g., in a manner set forth herein. Depending upon embodiment details, such optical or electromagnetic energy or photons can correspond to or include wavelengths in extreme ultraviolet (UV), deep UV, UV, visible, near infrared (IR), IR, mid IR, and/or deep IR portions of the optical or electromagnetic spectrum, for instance, wavelengths that fall between approximately 10 nanometers (nm) and 1 or more microns or micrometers (μm), e.g., multiple, several, or many μm, such as 1-24 μm, 1-30 μm, or 1-1000 μm. For purpose of brevity, in the description that follows such optical, electromagnetic, or photonic energy can simply be referred to as optical energy, corresponding optical, electromagnetic, or photonic illumination or irradiation can simply be referred to as optical illumination, and explosive initiation by way of such optical, electromagnetic, or photonic energy or illumination can simply be referred to as optical initiation.

In various embodiments, each of the first or proximal volume of explosive medium and the second or distal volume of explosive medium is a tertiary explosive medium that excludes each of a primary explosive and a secondary explosive. Hence, the first or proximal volume of explosive medium can be defined as a first or proximal volume or first or proximal target volume of tertiary explosive medium, and the second or distal volume of explosive medium can be defined as a second or distal volume or second or distal target volume of tertiary explosive medium. Consequently, in the description herein, reference to the first or proximal volume of explosive medium can compositionally indicate a tertiary explosive medium, and reference to the second or distal volume of explosive medium can compositionally indicate a tertiary explosive medium, in a manner readily understood by individuals having ordinary skill in the art, e.g., in view of particular chemical constituents, components, or species identified herein with respect to some embodiments of the first and second volumes of explosive media.

Depending upon embodiment details, the first volume of explosive medium and the second volume of explosive medium can be compositionally identical or different. For instance, the first volume of explosive medium and the second target volume of explosive medium can compositionally identical; or the first volume of explosive medium and the second volume of explosive medium can be categorically identical, analogous, or similar types of explosive media that contain at least some difference(s) with respect to their constituent components or formulation details; or the first volume of explosive medium and the second volume of explosive medium can be categorically different types of explosive media.

As indicated above, in response to or following the optical initiation of the first volume of explosive medium, various embodiments in accordance with the present disclosure can facilitate or trigger the production of a DDT in or detonate at least a second volume of explosive medium by way of chemical reaction, combustion front, and/or shock wave coupling from the first volume of explosive medium into the second volume of explosive medium, without requiring or in the complete absence of an explosives initiation chain that includes a primary explosive, and in some embodiments without requiring or in the complete absence of an explosives initiation chain that includes a secondary explosive. In many embodiments, detonation or reliable detonation of the second volume of explosive medium is achieved by way of providing an intermediate, intermediary, or intervening volume of explosive medium between the first volume of explosive medium and the second volume of explosive medium. In various embodiments, the explosive photoinitiation of the first volume of explosive medium couples an explosive combustion front or shock wave into the intermediate volume of explosive medium, which at least begins a DDT in the intermediate volume of explosive medium, such that the DDT or a detonation wave front is coupled from the intermediate volume of explosive medium into the second volume of explosive medium. The intermediate volume of explosive medium can thus explosively couple the first volume of explosive medium and the second volume of explosive medium. Because the intermediate volume of explosive medium is disposed between the first volume of explosive medium and the second volume of explosive medium, reference to or definition of the first volume of explosive medium as a proximal volume of explosive medium, and reference to or definition of the second volume of explosive medium as a distal volume of explosive medium, remains consistent with that indicated above.

The intermediate volume of explosive medium includes a fuel or fuel phase (e.g., an organic fuel or fuel phase) and an oxidizer (e.g., an organic or inorganic oxidizer salt). In several embodiments, the intermediate volume of explosive medium includes or is a liquid, gel-based, and/or binary explosive composition. A gel or gel-based explosive can be a water based or oil based explosive. For instance, depending upon embodiment details, a suitable gel-based explosive can include or be (a) gelled nitromethane formed with physical a gellant such as silica spheres, or by way of dissolving in a polymeric matrix such as guar gum, polymethylmethacrylate, or starch; (b) a napalm-based or napalm-like composition (e.g., formed of a fuel and a polymer); (c) a water based slurry or water gel explosive; or (d) aqueous AN with a polymeric binder. Individuals having ordinary skill in the relevant art will understand that some binary explosives are gel or gel-based explosives, while others are not. A suitable non-gel-based binary explosive can include or be (i) ditheylene glycol and sodium perchlorate, e.g., in a form identical, essentially identical, analogous, or similar to that described in U.S. Pat. No. 5,665,935, which is incorporated herein by reference in its entirety; (ii) a metal fuel suspended in a polyhydric alcohol, e.g., e.g., in a form identical, essentially identical, analogous, or similar to that described in U.S. Pat. No. 5,007,973, which is incorporated herein by reference in its entirety; (iii) hydrogen peroxide mixtures, e.g., in a form identical, essentially identical, analogous, or similar to that described in "Explosives based on hydrogen peroxide—A historical review and novel applications," G. Rarata and J. Smetek, *High-Energetic Materials* 2016, 8, pp. 56-62. In some embodiments, the intermediate volume of explosive medium can include or be another type of explosive, such as an emulsion explosive formed by blending an emulsion phase with cast particles, where the emulsion phase includes a continuous organic liquid fuel phase, a discontinuous inorganic oxidizer solution phase, and an emulsifier; and the cast particles include a mixture of sodium perchlorate, water, and dithylene glycol, e.g., in a form identical, essentially identical, analogous, or similar to that described in U.S. Pat. No. 6,702,909, which is incorporated herein by reference in its entirety.

In multiple embodiments, the intermediate volume of explosive medium does not contain a primary explosive and does not contain a secondary explosive. Notwithstanding the foregoing, in certain embodiments, the intermediate volume of explosive medium is a secondary explosive medium.

In many embodiments, the intermediate volume of explosive medium is less sensitive to initiation than an explosive medium or composition based on cyclotrimethylenetrinitramine (commonly referred to as RDX).

An optically, electromagnetically, or photonically initiable, detonable, explosive, or explodable apparatus or device in accordance with various embodiments of the present disclosure includes at least a first body structure portion that internally carries and confines the first volume of explosive medium, and which is couplable or coupled to each of (a) a set of optical, electromagnetic, or photonic energy sources and/or optical, electromagnetic, or photonic energy delivery apparatuses, devices, or structures configured for generating and/or outputting optical, electromagnetic, or photonic energy having particular or selected wavelengths, centre wavelengths, or bandwidths (e.g., one or more lasers, light emitting diodes (LEDs), flash illuminators, lenses, optical concentrators, reflective elements, beam splitters, and/or optical fibres, depending upon embodiment details), including an optical, electromagnetic, or photonic energy delivery interface configured for directing such energy or photons into portions of the first volume of explosive medium in one or more manners; and (b) an additional body structure portion that internally carries and confines the second volume of explosive medium. The first body structure portion includes one or more of a housing, vessel, full or partial enclosure or confinement structure, cavity, chamber, channel, or passage that holds the first volume of explosive medium during the application of optical energy thereto and the explosive initiation thereof. An optically, electromagnetically, or photonically initiable, explosive, or explodable apparatus or device can be referred to herein as a photoinitiation device for purpose of brevity.

Another or further optically, electromagnetically, or photonically initiable, detonable, explosive, or explodable apparatus or device, or an optically, electromagnetically, or photonically detonable or reliably detonable device in accordance with various embodiments of the present disclosure includes the first body structure portion as set forth above, as well as the additional body structure portion indicated above. In multiple embodiments, the additional body structure portion includes or is formed as each of (i) an intermediate body structure portion that internally carries and confines the intermediate volume of explosive medium, and which is couplable or coupled to or interfaceable or interfaced or integrated with the first body structure portion such that a combustion front and/or explosive shock wave generated by the optical initiation of the first volume of explosive medium can be coupled or propagate into the intermediate volume of explosive medium to thereby initiate and possibly detonate the intermediate volume of explosive medium, e.g., in some embodiments by way of direct contact between at least some of the first volume of explosive medium and some of the intermediate volume of explosive medium; and (ii) a distal body structure portion that internally carries and confines the second target volume of explosive medium, and which is couplable or coupled to or interfaceable or interfaced or integrated with the intermediate body structure portion such that detonation of the second volume of explosive medium by the initiation and/or detonation of the intermediate volume of explosive medium, e.g., in some embodiments by way of direct contact between at least some of the intermediate volume of explosive medium and the second volume of explosive medium. The additional body structure portion includes one or more of a housing, vessel, full or partial enclosure or confinement structure, cavity, chamber, channel, or passage that holds each of the intermediate volume of explosive medium and the second volume of explosive medium by way of the intermediate and distal body structure portions, respectively. An optically, electromagnetically, or photonically detonable apparatus or device can also be referred to herein as a photoinitiation device or a photodetonation device for purpose of brevity.

In general, an optical, electromagnetic, or photonic initiation system or apparatus in accordance with various embodiments of the present disclosure includes some or each of: a photoinitiation device as set forth above, e.g., which provides the first body structure portion; a set of optical energy sources and/or optical energy delivery apparatuses, devices, or structures as indicated above; a set of power sources (e.g., a coupling to line power, and/or one or more batteries), power management circuitry, and energy storage and delivery or discharge elements or structures (e.g., capacitors) for powering the optical energy source(s) and other electronic devices or components; a master control system or controller (e.g., which includes a processing unit or processor such as a microprocessor or microcontroller, and/or a state machine, as well as a memory for storing signals, data, control instructions or selections, and particular system, apparatus, or device status or state information, and which is coupled to at least one power source); at least one local controller or control unit (e.g., which includes a processing unit or processor such as a microprocessor or microcontroller, and/or a state machine, as well as a memory for storing signals, data, control instructions or selections, and particular system, apparatus, or device status or state information, and which is coupled to at least one power source) remote from the master control controller; for the master controller as well as one or more local control units, a communication unit or communication circuitry configured for wire-based and/or wireless signal communication (e.g., radio frequency (RF) and/or magnetic induction (MI) signal based communication); at least one user interface device providing a user interface (e.g., a graphical user interface (GUI)) by which a user can communicate with and manage particular operations performed by the master controller and/or the local control unit(s), and monitor, manage, or direct aspects of system, apparatus, or device operation. An optical, electromagnetic, or photonic initiation system can be referred to as a photoinitation An optical, electromagnetic, or photonic detonation system or apparatus, or reliable optical, electromagnetic, or photonic detonation system or apparatus, in accordance with various embodiments of the present disclosure includes a photoinitiation or photodetonation device as set forth above containing each of the first or proximate volume of explosive medium, possibly or commonly the intermediate volume of explosive medium depending upon embodiment details, and the second or distal volume of explosive medium, as well as at least some or each of the set of optical energy sources; the set of power sources; the power management circuitry; the master control system or controller; at least one local controller or control unit; the communication unit(s) and/or communication circuitry; and at least one user interface as set forth above.

Embodiments in accordance with the present disclosure have utility in multiple industries or industrial applications, particularly commercial explosive or blasting operations such as explosive or blasting operations performed as part of mineral mining, quarrying, civil tunneling, civil demolition, geophysical formation characterization, seismic exploration, and/or hydrocarbon energy source or fuel production or extraction activities or procedures (e.g., oil and gas industry operations including exploration and well perforation procedures). Individuals having ordinary skill in the art will understand that embodiments in accordance with the present disclosure are not limited to such industries or industrial applications, and can be applied in other industries or industrial applications, for instance, fireworks, rocketry, aerospace, propellants, gas generation, and explosive or explosion welding.

Multiple embodiments in accordance with the present disclosure are configured for at least partially residing and operating in a borehole or blasthole that has been loaded with a column of one or more associated or adjunctive tertiary explosives media (e.g., a set of blasting agents). One or more portions of or locations within this column will contain an optical initiation device or an optical detonation device in accordance with an embodiment of the present disclosure, as set forth above. Other portions of this column can contain the associated or adjunctive tertiary explosive medium or media, which can be chemically or compositionally identical to, related to, or different from the first and/or second volumes of explosive media. At least portions of the associated or adjunctive tertiary medium or media in the column can be detonated in response to the optical initiation of the first volume of explosive medium, e.g., by way of an optical initiation and DDT generation sequence involving the optical initiation of the first volume of explosive medium contained or confined in a first body structure portion as set forth above, which gives rise to the initiation and generation of a DDT within a second body structure portion that carries each of the intermediate volume of explosive medium and the second volume of explosive medium as set forth above and the detonation of the second volume of tertiary explosive medium, which couples a detonation front into the column that detonates the associated or adjunctive tertiary explosives medium/media in the column. The foregoing further applies to an array of boreholes or blastholes that have been loaded in a corresponding, analogous or similar manner, as will be readily understood by individuals having ordinary skill in the relevant art.

In view of the foregoing, various embodiments in accordance with the present disclosure can optically initiate or generate a DDT in or detonate the second volume of explosive medium and detonate a column containing one or more tertiary explosives media without or in the complete absence of each of a conventional detonator and a conventional booster.

In several embodiments, an oxidizer salt within the first volume of explosive medium and/or the second volume of explosive medium includes or is an inorganic oxidizer salt. In multiple embodiments, the first and/or second volume of explosive medium contains or uses AN as its explosive base. For instance, depending upon embodiment details, the first and/or second volume of explosive medium can include or be at least one of AN, AN prill, Ammonium Nitrate Fuel Oil (ANFO), an AN-containing or AN-based emulsion explosive (e.g., a conventional emulsion explosive in which AN is present as an inorganic oxidizer salt), heavy ANFO, and an AN-containing slurry or watergel explosive composition, in a manner readily understood by individuals having ordinary skill in the relevant art. Individuals having ordinary skill in the relevant art will also recognize that embodiments in accordance with the present disclosure are not limited to the initiation or detonation of AN-containing or AN-based tertiary explosive media. For instance, in some embodiments in accordance with the present disclosure, the first and/or second volume of explosive medium can be based on or include a different or other inorganic oxidizer salt or organic oxidizer salt, such as sodium nitrate, calcium nitrate, potassium nitrate, sodium nitrite, calcium nitrite, sodium perchlorate, potassium perchlorate, ammonium perchlorate, sodium chlorate, or ammonium chlorate.

In multiple embodiments, the intermediate volume of explosive medium includes or utilizes nitromethane (a liquid fuel), and further includes one or more additional components such as ethylenediamine (EDA), ethanolamine, other amines (for instance, short chain amines, e.g., having 2-3 carbon atoms), fumed silica, aluminium, and/or ammonium nitrate. In other embodiments, the intermediate volume of explosive medium can utilize nitroethane or nitropropane instead of nitromethane. Thus, in some embodiments, the intermediate volume of explosive medium is a binary explosive medium. The intermediate volume of explosive medium can be a gel-based explosive medium (e.g., a water gel explosive medium) in a number of embodiments.

In various embodiments, the optical initiation (e.g., optical explosive initiation) of the first volume of explosive medium is aided, enhanced, or caused (e.g., most directly caused) by way of the addition of one or more photothermal absorbers thereto, in at least portions of the first volume of explosive medium that are exposable or exposed to photonic energy, and typically in at least additional portions of the first volume of explosive medium that are adjacent thereto. A photothermal absorber can be defined as a photothermal material, i.e., a material that absorbs photonic energy (e.g., at least significant or large amounts of photonic energy applied thereto), and which directly or primarily converts absorbed photonic energy into thermal energy, e.g., a photothermal absorber's response to its absorption of photonic energy is direct heating. In the context of an explosive medium, e.g., formed of a fuel or fuel phase and an oxidizer salt, which carries a photothermal absorber therein (e.g., in the form of particles and/or droplets), the optical irradiation of such an explosive medium results in the initiation of the explosive medium by way of photothermal processes, which include or are expected to include photon absorption by the photothermal absorber, the creation of localized hot spots around the photothermal absorber caused by the photonic heating thereof, thermal energy transfer from the photonically heated photothermal absorber to the oxidizer salt, and thermal decomposition or thermolysis of the oxidizer salt, in a manner readily understood by individuals having ordinary skill in the relevant art. For purpose of brevity, a photothermal absorber can simply be referred to hereafter as a thermal absorber.

In various embodiments, the thermal absorber includes or is bitumen, which is commonly referred to as asphalt in certain countries. In view of terminology commonly used in other countries in which the terms bitumen and asphalt do not refer to identical compositions and are not interchangeable, bitumen can be defined as a liquid binder (e.g., typically in the form of a black, viscous liquid) that is used in forming asphalt, where asphalt specifically is understood to include particulate components or materials such as stone aggregate(s), sand, and/or gravel. In various embodiments considered herein in which the thermal absorber includes or is bitumen, the thermal absorber does not include or intentionally include such particulate components or materials from which asphalt is formed. The thermal absorber can additionally or alternatively include or be one or more of crude oil, gilsonite, bunker oil, and coal dust.

In multiple embodiments, the fuel or fuel phase within at least the first volume of explosive medium and possibly within the second volume of explosive medium can carry, include, or incorporate bitumen therein, e.g., in a manner essentially identical, analogous, generally analogous, similar, or generally similar to that described in U.S. Pat. No. 4,404,050, which is incorporated by reference herein in its entirety, or crude oil, gilsonite, bunker oil, or coal dust.

In other embodiments in which the first volume of explosive medium carries a thermal absorber, the thermal absorber includes or is formed from one or more entirely carbon based substances or materials, e.g., the thermal absorber includes one or each of carbon black and carbon nanoparticles such as carbon nanotubes, nanorods, graphene, or fullerenes (e.g., buckyballs or nano-onions). In general, an efficient, effective, near-optimal, or optimal thermal absorber can include or be a substance or material that closely approximates a black body optical radiation absorber.

In still further embodiments in which the first volume of explosive medium carries a thermal absorber, the thermal absorber includes or is formed from one or more types of metal nanostructures or nanoparticles, for instance, gold (Au) nanoparticles, silver (Ag) nanoparticles, or copper (Cu) nanoparticles (e.g., coated Cu nanoparticles), which can have a mean diameter between approximately 10-50 nm. Such metal nanoparticles can correspond to or be categorized as surface plasmon absorbers or plasmonic metal nanostructures, in a manner that individuals having ordinary skill in the relevant art will recognize. In various embodiments, such metal nanoparticles include or are nanospheres.

In certain embodiments, the second volume of explosive medium can also carry a thermal absorber, although this is not required in all embodiments.

In several representative embodiments, the first volume of explosive medium is an AN based emulsion explosive medium having constituents that can be defined as:

(a) an oxidizer system based on AN alone; AN plus sodium nitrate (SN); AN plus sodium perchlorate (SP); AN plus SN plus SP; AN plus calcium nitrate (CN); AN plus SN plus CN; or AN plus CN plus potassium nitrate (KN);

(b) water, in an amount of 5-25% by weight, e.g., approximately 10-17% by weight;

(c) a fuel or oil phase based on one or more of mineral oil; unrefined or partly refined petroleum products; synthetic oil such as biodiesel or chemically modified petroleum versions; vegetable based oils such as soya or hydrogenated vegetable oil(s);

(d) a surfactant, such as a polymeric emulsifier, a polyisobutylene succinic anhydride (PIBSA) based emulsifier, or a fatty acid based surfactant; and (e) bitumen, e.g., in an amount of 0.1%-50% by weight of the fuel or oil phase; and (f) possibly a sensitizing agent, e.g., glass microspheres or microballoons, where the relative weight percentages among such constituents can be adjusted or selected to provide intended initiation and/or detonation properties, while maintaining good or adequate emulsion stability (e.g., for in-the-field use), in a manner readily understood by individuals having ordinary skill in the relevant art.

Surprisingly, the inventors named on the present application discovered that various test samples of AN based emulsion explosive media having bitumen therein as a thermal absorber, including samples that were formulated differently from each other, were readily initiable in response to optical illumination. More particularly, during experiments conducted with a 35 Watt (W), 4100 lumen white light halogen bulb irradiation using a Flash Torch handheld flashlight produced by Wicked Lasers (Wicked Lasers, Euro IntlChoice Tech. Ltd, Cypress, www.wicked-lasers.com), in which the test samples were positioned beneath (e.g., 2-10 centimeters (cm) or about 5 cm below) this light source, the inventors discovered that such test samples readily directly initiated or combusted in open air. The inventors subsequently determined that AN based emulsion explosive media containing bitumen were suitable candidates or well-suited for use in or as the first volume of explosive medium, as further detailed below.

Moreover, the inventors named on the present application determined that bitumen is well or very well suited for use in various emulsion explosive media because of ease of homogeneous distribution therein, and likelihood of retaining adequate emulsion stability. Moreover, analogous, similar, or generally similar considerations to that for bitumen apply or can be expected to apply to various emulsion explosive media containing substances such as crude oil, gilsonite, bunker oil, and coal dust. The inventors thus determined that AN based emulsion explosive media containing crude oil, gilsonite, bunker oil, and coal dust are suitable candidates or well-suited for use in or as the first volume of explosive medium.

In several representative embodiments, the second volume of explosive medium is also an AN based emulsion explosive medium having constituents that can be defined in a manner that is identical, essentially identical, analogous, or similar to that above for the first volume of explosive medium, e.g., the second volume of explosive medium can be identical or similar to the first volume of explosive medium. In some representative embodiments, the second volume of explosive medium need not or does not contain a photothermal absorber such as bitumen, crude oil, gilsonite, bunker oil, or coal dust.

As an alternative or in addition to photothermal initiation as described above, the optical initiation of the first volume of explosive medium can occur by way of photoexcitation or photokinetic processes in response to the application of photonic energy thereto, e.g., without requiring, relying upon, primarily relying upon, or utilizing photothermal processes that occur by way of the use of a thermal absorber. Photokinetic processes generate particular reactive chemical species in the first volume of explosive medium by way of photoexcitation.

As individuals having ordinary skill in the relevant art will understand, in general, photoexcitation, e.g., by way of directing photons having wavelengths in the UV and/or visible portions of the electromagnetic spectrum, into the first volume of explosive medium excites the electronic state(s) of reactive species therein. Particular electronic transitions that give rise to excited state(s) are possible, e.g., depending upon the wavelength(s) used. These excited state(s) decay (e.g., by way of relaxation processes), which can break chemical bonds and produce chemical species fragments. Depending upon wavelength, specific chemical bonds can be excited. The vibrational and rotational state(s) of chemical species can also be excited, e.g., at longer wavelengths. It can be noted that with sufficiently high intensity photoexcitation, excited states will be generated even if the wavelength(s) used are not on-resonance or precisely on-resonance.

However, photokinetic initiation processes require a larger energy budget than photothermal initiation processes. Photokinetic initiation processes can be aided in some embodiments by way of one or more photoexcitation transfer agents, which can include one or more types of transfer agents, added or incorporated into the first volume of explosive medium. A transfer agent can include or be a compound or composition that is photoexcitable (e.g., by way of single photon and/or multi-photon absorption processes), and which can transfer energy corresponding to photoexcited electronic states to the oxidizer salt either directly or by way of the generation of particular transfer agent photodecomposition products. In some embodiments, a photoexcitation transfer agent can include or be a dye such as 4-(Dicyanomethylene)-2-methyl-6-(4-dimethylaminostyryl)-4H-pyran (DCM) dye, or Rhodamine 6G dye.

Photoexcitation and photokinetic initiation of the first volume of explosive medium produces reactive or highly reactive neutral free radicals, including oxygen free radicals; and ionic species (i.e., species carrying a nonzero net electrical charge) that are directly and/or indirectly generated by way of photoexcitation. Ionic species can include one or more of ionic: (i) isomers of the oxidizer salt; (ii) photodecomposition products of the oxidizer salt; (iii) isomers of one or more transfer agent(s) carried by the first volume of explosive medium; and (iv) photodecomposition products of the transfer agent(s). The specific or preferential generation of reactive species in the first volume of explosive medium by way of photokinetic processes occurs through photoexcitation of electronic states in one or more of the oxidizer salt, the transfer agent(s), and photodecomposition products of the oxidizer salt and/or the transfer agent(s).

In embodiments in which the first volume of explosive medium is photokinetically initiated, photons directed into the first volume of explosive medium can be intentionally or preferentially selected to have appropriate optical properties, characteristics, or parameters for direct absorption (e.g., resonant excitation) and/or breakage of specific chemical bonds within (i) the oxidizer salt, and/or optionally or alternatively (ii) one or more optical transfer agents (e.g., an optically-sensitive photoexcitation transfer agent) carried or produced (e.g., by way of photodecomposition) within the first volume of explosive medium, depending upon embodiment details.

Photoexcitation of specific oxidizer salt and/or transfer agent electronic states triggers and/or results in chemical reactions and exothermic energy release, which can directly or indirectly cause explosive initiation of the first volume of explosive medium. More particularly, without being bound by any particular theory, depending upon embodiment details, photokinetic initiation of the first volume of explosive medium can occur by way of processes involving or including (a) photoexcitation of particular electronic states in the oxidizer salt, and/or (b) photoexcitation of particular electronic states in the transfer agent(s) that may be present, followed by one or more of (c) photodissociation, photodecomposition, or photolysis of the oxidizer salt; (d) photodecomposition of the transfer agent(s); (e) excited electron energy transfer between the transfer agent(s) and/or one or more photodissociation products thereof and the oxidizer salt; (f) explosive fragmentation of the transfer agent(s) and the generation of shock waves therefrom; and (g) chemical reactions between photodissociation products of the transfer agent(s) and/or the oxidizer salt, which further generate chemical species that react with the oxidizer salt and/or its decomposition products, and which can facilitate the continuation or maintenance of chemical reactions and/or provide sufficient heat and pressure to explosively initiate the first volume of explosive medium. Photoexcitation can occur by way of single photon and/or multi-photon induced transitions to excited electronic states, in a manner readily understood by individuals having ordinary skill in the relevant art.

A photoexcitation transfer agent is compositionally and behaviorally distinct from, and does not primarily function as, a thermal absorber. That is, a photoexcitation transfer agent does not facilitate or aid optical initiation primarily by way of photothermal processes. Correspondingly, a thermal absorber is distinguishable or distinct from (e.g., a thermal absorber may not be a part of or chemically identical to) each of the oxidizer salt and any transfer agent(s) that facilitate or aid initiation primarily by way of photokinetic processes. For purpose of simplicity, in the description that follows, a photoexcitation transfer agent can be referred to as a transfer agent.

In embodiments in which the first volume of explosive medium carries a transfer agent, the second volume of explosive medium need not carry a transfer agent, and the second volume of explosive medium can carry a thermal absorber, although this is not required in all embodiments.

In embodiments in which the first volume of explosive medium carries a transfer agent, the first volume of explosive medium can be an AN based emulsion explosive medium, e.g., in a manner similar to that described above, but which need not carry or does not carry a phothermal absorber such as bitumen, crude oil, gilsonite, bunker oil, or coal dust, or another photothermally absorbing substance, material, composition, or structure (e.g., carbon nanotubes).

Numerical Simulation of Photothermal and Photokinetic Initiation Processes

Numerical simulation or modelling of photothermal initiation processes within a first volume of explosive medium were conducted based on laser irradiation of the first volume of explosive medium, with a laser center wavelength of 808 nm and a beam diameter of 330 μm, where the representative first volume of explosive medium contained bitumen as a thermal absorber. For such numerical simulation, the first volume of explosive medium having bitumen as a thermal absorber can include each of ammonium nitrate; sodium nitrate or sodium nitrite; sodium perchlorate or sodium chloride; water; a conventional emulsifier such as DN60, E26, or E476 (PIBSA base with diethanol amine); diesel oil; bitumen; and possibly or optionally a sensitizing agent such as glass microballoons. Thus, the numerically simulated first volume of explosive medium carrying bitumen as a thermal absorber can be an ammonium nitrate based emulsion explosive medium.

For instance, with respect to approximate weight percentages, a representative first volume of explosive medium carrying bitumen can be defined as an initial formulation having 62.6% ammonium nitrate; 8.9% sodium nitrate; 10.2% sodium perchlorate; 9.8% water; 2.3% DN60, E26, or E476 emulsifier; 2.7% diesel oil; and 3.4% Suncor PG64-22 bitumen (Suncor Energy, Alberta, Canada), where 95.9% of the initial formulation is combined with 4.1% glass microspheres or microballoons (e.g., K-20 glass microballoons, 3M Corporation, Maplewood, Minn., USA) to define a final formulation suitable for numerical simulation as well as experimentation purposes.

An optical absorption spectrum corresponding to an actual physical sample of this first volume of explosive medium containing bitumen, as well as an analogous version thereof without bitumen, as determined by measurements performed thereon, is shown in FIG. 1, which indicates that the bitumen is highly or very highly absorbing across a wide or very wide range of optical wavelengths, including the laser center wavelength under consideration. It can be noted in FIG. 1 that the signal gets noisy below approximately 750 nm because at an absorbance approaching or approximately equal to 6, about 0.0001% of the light was transmitted through the sample, which contributed to detector noise. A slight amount of "absorbance" can be seen in the bitumen-free ANE results, most likely due to light scattering off oxidizer droplets.

Photothermal numerical simulation was based on information, including relevant equations indicated below, obtained from the following publications: (a) "Thermal decomposition of ammonium nitrate based composites," J. C. Oxley, S. M. Kaushik, and N. S. Gilson, *Ther. Acta,* 153 (1989), pp. 269-286 (https://doi.org/10.1016/0040-6031(89)85441-3); and (b) "Modeling Smoke Visibility in CFD," K. Kang and H. M. Macdonald, *Fire Safety Science* 8, pp. 1265-1276 (http://dx.doi.org/10.3801/IAFSS.FSS.8-1265). It can be noted that a thermal conduction only assumption is justified based on domain dimensions, as individuals having ordinary skill in the relevant art will understand.

For numerical simulation of photothermal initiation, absorbed electromagnetic radiation power density (W/m$^3$) is defined as:

$$Q_{phototherm}=I_o\alpha(1-R)e^{-\int\alpha dz} \tag{1}$$

The power density (W/m$^3$) derived from the heat of reaction is defined as:

$$Q_{reac}=\sum_i H_{i_{reac}}M_{w_i}R_i \tag{2}$$

The numerical simulation criterion for photothermal initiation is:

$$Q_{reac}/Q_{phototherm}>1 \tag{3}$$

which stipulates that rate of heat generation by photothermal decomposition and initiation of the first volume of explosive medium exceeds the rate of heat added to the system by photonic irradiation of the first volume of explosive medium, and thus the photothermal processes that initiate the first volume of explosive medium are self-sustaining, where R=reflectance Io=Laser irradiance (W/m$^2$)

$\alpha$=extinction coefficient (1/m)

c=speed of light in a vacuum (m/s)

dz=path of radiation, integrated in the numerical scheme (m)

$R_i$=rate of reaction for the ith species (mol/m$^3$·s)

$M_{w_i}$=Molecular weight of the ith species (kg/mol)

$H_{i_{reac}}$=Enthalpy of reaction of the ith species (J/kg)

with respect to Equations (1)-(3) above. It can be noted that the extinction coefficient is a function of time, in a manner that individuals having ordinary skill in the relevant art will understand.

Numerical simulation or modelling of photokinetic initiation processes within another representative first volume of explosive medium were also conducted based laser irradiation of the first volume of explosive medium using two laser center wavelengths, namely, 305 nm and 354.5 nm, and a laser beam diameter of 330 μm, where this first volume of explosive medium was defined as an AN based emulsion explosive medium that lacked a thermal absorber, and which also lacked a transfer agent. For such numerical simulation, the first volume of explosive medium can include each of ammonium nitrate; sodium nitrate or sodium nitrite; sodium perchlorate or sodium chloride; water; a conventional emulsifier such as DN60, E26, or E476 (PIBSA base with diethanol amine); and diesel oil. With respect to the numerical simulation of photokinetic initiation processes, the first volume of explosive medium does contain bitumen and does not contain glass microballoons, yet otherwise maintains compositional consistency with respect to the formulation used for the numerical simulation of photothermal initiation processes. The representative first volume of explosive medium for numerical simulation of photokinetic processes can be defined as a formulation having ammonium nitrate; sodium nitrate; water; and paraffin oil, in a manner readily understood by individuals having ordinary skill in the relevant art.

Photokinetic numerical simulation was based on information, including relevant equations indicated below, obtained from the following publications: (a) "Photochemistry of nitrite and nitrate in aqueous solution: a review," J. Mack and J. R. Bolton, *J. Photochem. Photobio.* 128 (1999), pp. 1-13 (https://doi.org/10.1016/51010-6030(99)00155-0); and (b) "Kinetics Parameters Evaluation of Paraffin-Based Fuel," G. P Santos, P. T. Lacava, S. R. Gomes, and J. A. Rocco, *Proc. ASME* 2013 *Int. Conference.*

For numerical simulation of photokinetic initiation, absorbed electromagnetic radiation power density (W/m$^3$) for an i$^{th}$ absorbing species is defined as:

$$Q_{rad_i}=I_{\lambda_{laser}}\kappa_i^{\lambda_{laser}}C_ie^{-\int\kappa_i^{\lambda_{laser}}C_idz} \tag{4}$$

and total absorbed electromagnetic radiation power density (W/m$^3$) is defined as:

$$Q_{rad}=\sum_i Q_{rad_i} \tag{5}$$

The reaction rate for the i$^{th}$ absorbing species is defined as:

$$R_{rad_i}=\frac{v_i\phi I_{\lambda_{laser}}\lambda_{laser}\kappa_i^{\lambda_{laser}}}{hN_Ac}C_ie^{-\int\kappa_i^{\lambda_{laser}}C_idz} \tag{6}$$

The heat of reaction power density ($W/m^3$) is a mix of photokinetic and Arrhenius kinetic processes in the numerical simulation, and is defined as:

$$Q_{photoreac} = \sum_i H_{i_{reac}} M_{w_i} R_i \quad (7)$$

where in Equations (4)-(7), $I_{\lambda_{laser}}$=incident radiation from laser ($W/m^2$)

$\kappa_i^{\lambda_{laser}}$=Napierian extinction coefficient for the ith species ($m^2/mol$)

$\phi$=quantum yield (unitless)

$C_i$=concentration of the ith species ($mol/m^3$)

$\lambda_{laser}$=laser wavelength at which reactions can take place ($W/m^2$)

h=Planck's constant (J·s)

$N_A$=Avogadro's number (1/mol)

c=speed of light in a vacuum (m/s)

$v_i$=stoichiometric coefficient (unitless)

and other parameters are defined as set forth above with respect to Equations (1)-(3).

For the photokinetic numerical simulation, combustion kinetics are Arrhenius. The criterion for ignition used in the photothermal numerical simulation case cannot be applied in the photokinetic numerical simulation case. The reaction rate, and therefore the reaction power density, and the radiation power density, are interdependent. The ratio used in the photothermal case would be a nearly non-unitary constant for all values of time in the photokinetic case. The appropriate criterion is when the rate of reaction for the combustion of the oil phase passes through a maximum. Physically, this corresponds to the passage of a reaction wave through the computational domain.

Figure 2:
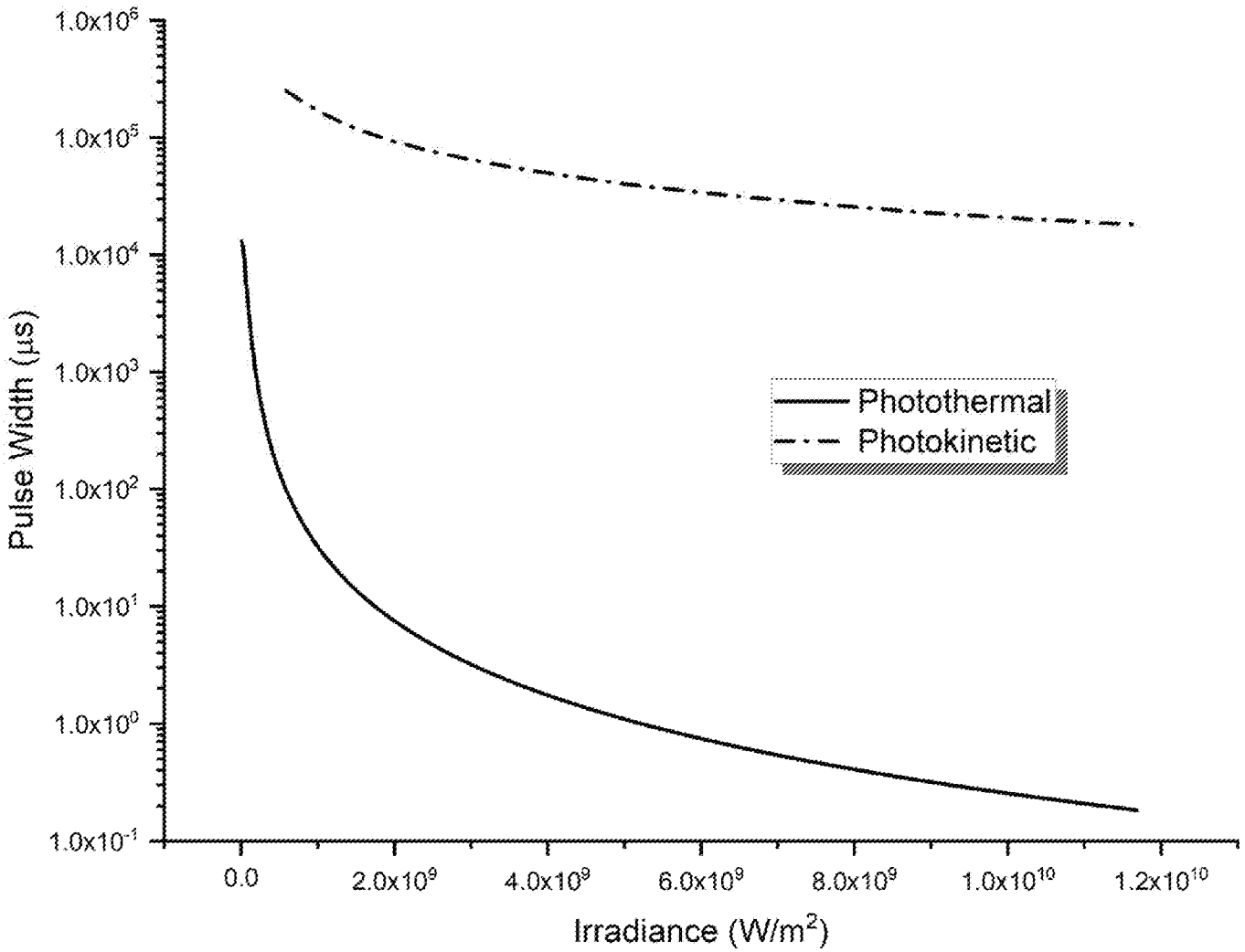
FIG. 2 is graph or plot showing laser pulse width versus laser beam irradiance for photothermal and photokinetic numerical simulation results for optical initiation of a first volume of explosive medium.

FIG. 2 is graph or plot based on the photothermal and photokinetic numerical simulation results, which shows laser pulse width versus laser beam irradiance. From this plot, it is apparent that the photothermal system is more efficient for the ignition of tertiary explosive media by several orders of magnitude. There are two reasons for this: firstly, the extinction coefficient is more advantageous in the case of the bitumen-containing photothermal system compared to the photokinetic system; and secondly, the transient decrease in the extinction coefficient (due to burning of the bitumen in the photothermal case, thus producing radiation absorbing smoke, and in the photokinetic case due to the decrease in the absorbing reactants) is less pronounced in the photokinetic case.

Figure 3:
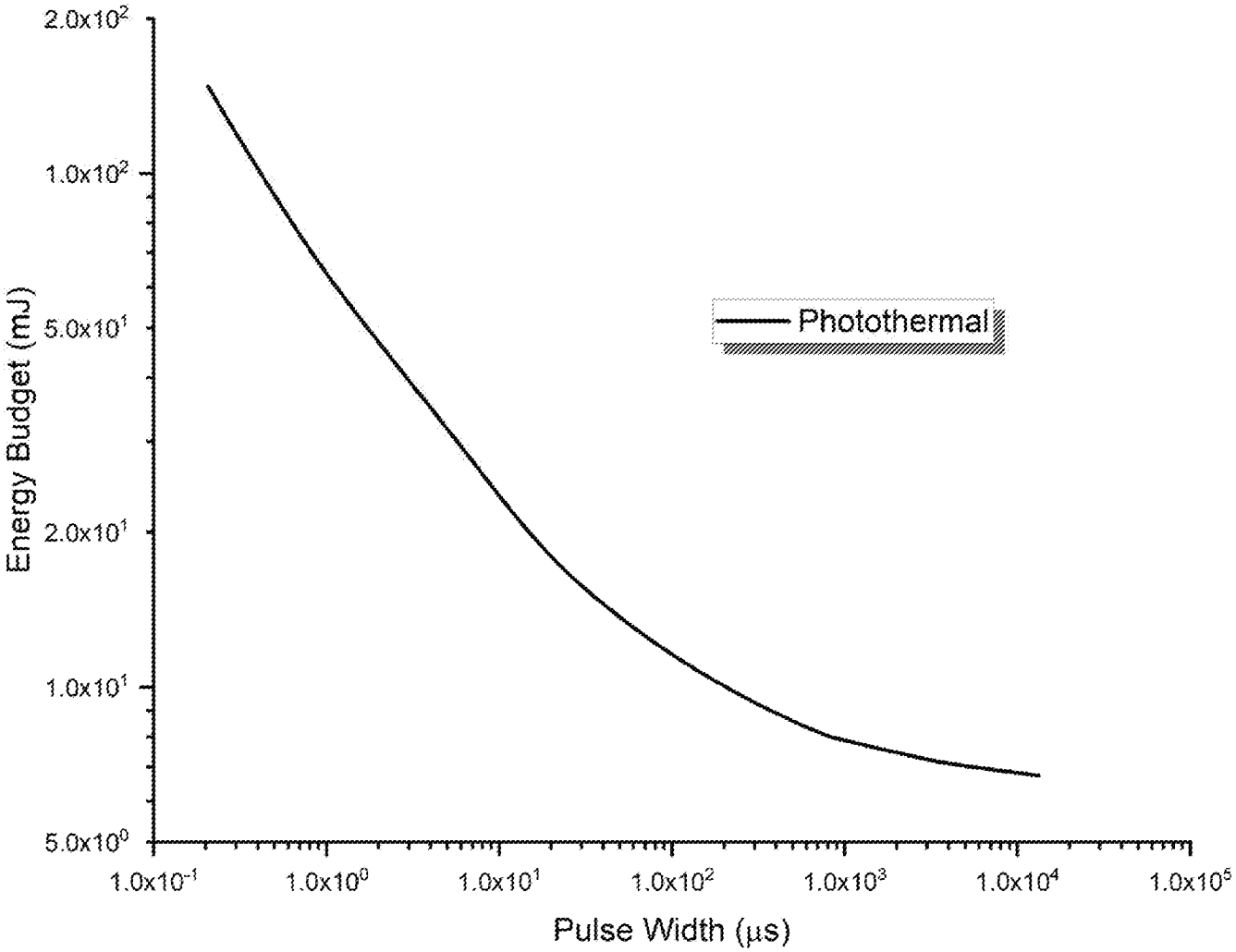
FIG. 3 is a graph or plot showing required energy budget versus laser pulse width based on the photothermal numerical simulation results corresponding to FIG. 2.

FIG. 3 is a graph based on the photothermal numerical simulation results, which shows required optical energy budget versus laser pulse width. As expected, the energy budget follows the same trend as that identified with respect to FIG. 2 above.

Figure 4:
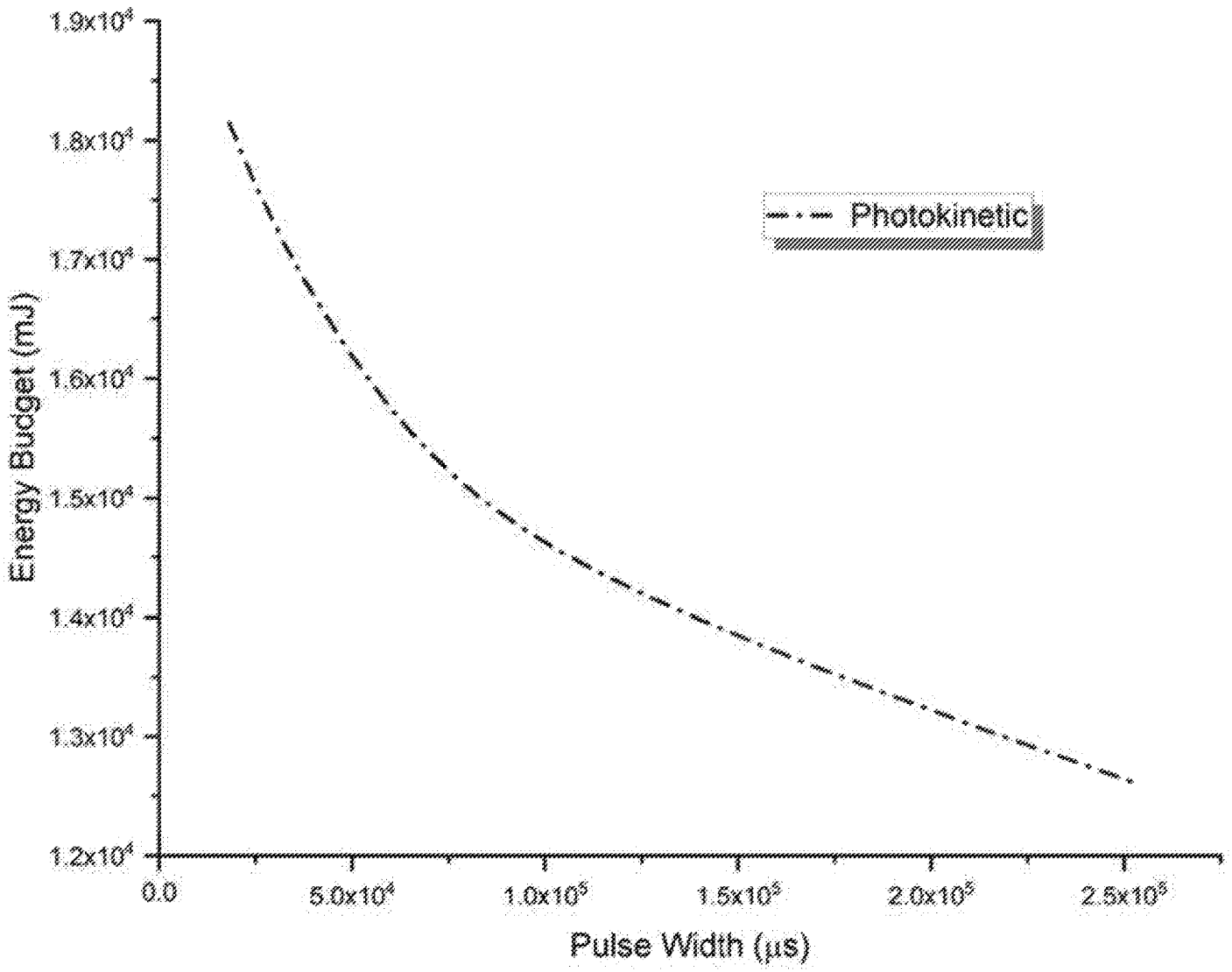
FIG. 4 is a graph or plot showing required energy budget versus laser pulse width based on the photokinetic numerical simulation results corresponding to FIG. 2.

FIG. 4 is a graph based on the photokinetic numerical simulation results, which shows required optical energy budget versus laser pulse width. Based on the numerical simulation results and in view of FIGS. 2-4, the photothermal system can be implemented with a continuous wave diode or fiber laser. Additionally, for the photothermal system, only simple lens systems such as fiber optics need to be considered. Implementation of the photokinetic system is more complex or elaborate compared to implementation of the photothermal system. Specifically, for the photokinetic case, significantly more elaborate laser/optical systems are required.

Relative to the foregoing numerical simulation results, it can be noted that in the photokinetic numerical simulation case, radiation absorption depends only on the absorption of the reactants. This is a valid approximation since none of the reaction components absorb at the laser wavelengths under consideration, i.e., 305 and 354.5 nm.

Also, the numerical simulation results indicate that photokinetic processes are orders of magnitude slower than photothermal processes with respect to causing self-sustaining initiation of the first volume of explosive medium. It can be noted that at the time at which the rate of combustion in the photokinetic case reaches its maximum, the radiation power density is multiple orders of magnitude (O(4) to O(5)) smaller than that for the photothermal case. Further to this point, initiation of the first volume of explosive medium depends upon combustion, which is a temperature dependent process. However, the power density in the photokinetic case decreases with decreasing reactant concentration, which is not a drawback seen in the photothermal case.

Notwithstanding the foregoing photokinetic numerical simulation results, physical implementations of photokinetic initiation systems and devices are possible with currently available technology, as further supported by experimental data described hereafter.

A group led by Prof. Elliot R. Bernstein at Colorado State University (Fort Collins, Colo. USA) has conducted work on the laser ablation of AN ("Isomeric Structures of Isolated Ammonium Nitrate and its Hydrogenated Species Identified Through PES Experiments and DFT Calculations", unpublished manuscript as of the priority date of this patent application), involving Nd:YAG laser ablation of pure AN and also AN in the presence of DCM dye at 532 nm in association with photoelectron spectroscopy (PES) measurements at 355 nm and 266 nm, and the analysis of AN dissociation mechanisms and molecular species that exist upon such laser ablation. The overall experimental setup employed by this group is described by H.-S. Im and E. R. Bernstein in "On the initial steps in the decomposition of energetic materials from excited electronic states," *J. Chem. Phys.*, 2000, 113, 7911; and Zhen Zeng and E. R. Bernstein in "Photoelectron spectroscopy and density functional theory studies of N-rich energetic materials," *J. Chem. Phys.*, 2016, 145, 154302.

This group's experiments have demonstrated that laser ablation of pure AN at 532 nm produced multiple ionic species, including hydrogenated cluster ions having 0-5 hydrogen atoms; and laser ablation of AN in the presence of DCM dye at 532 nm produced a single hydrogenated cluster anion having 1 hydrogen atom.

More particularly, with respect to the laser ablation of pure AN, a sample of neat AN was dried onto a substrate, which was wrapped onto a drum. Nd:YAG laser pulses with a beam diameter of 1 mm, a pulse width of 7 ns, and a pulse energy of 0.3 mJ were fired at the AN-carrying substrate wrapped around the drum as the drum was rotated. Product species corresponding to each pulse were repeatedly sampled in a time of flight mass spectrometer (TOFMS) at sampling times of 80 microseconds after laser pulse delivery.

Figure 5A:
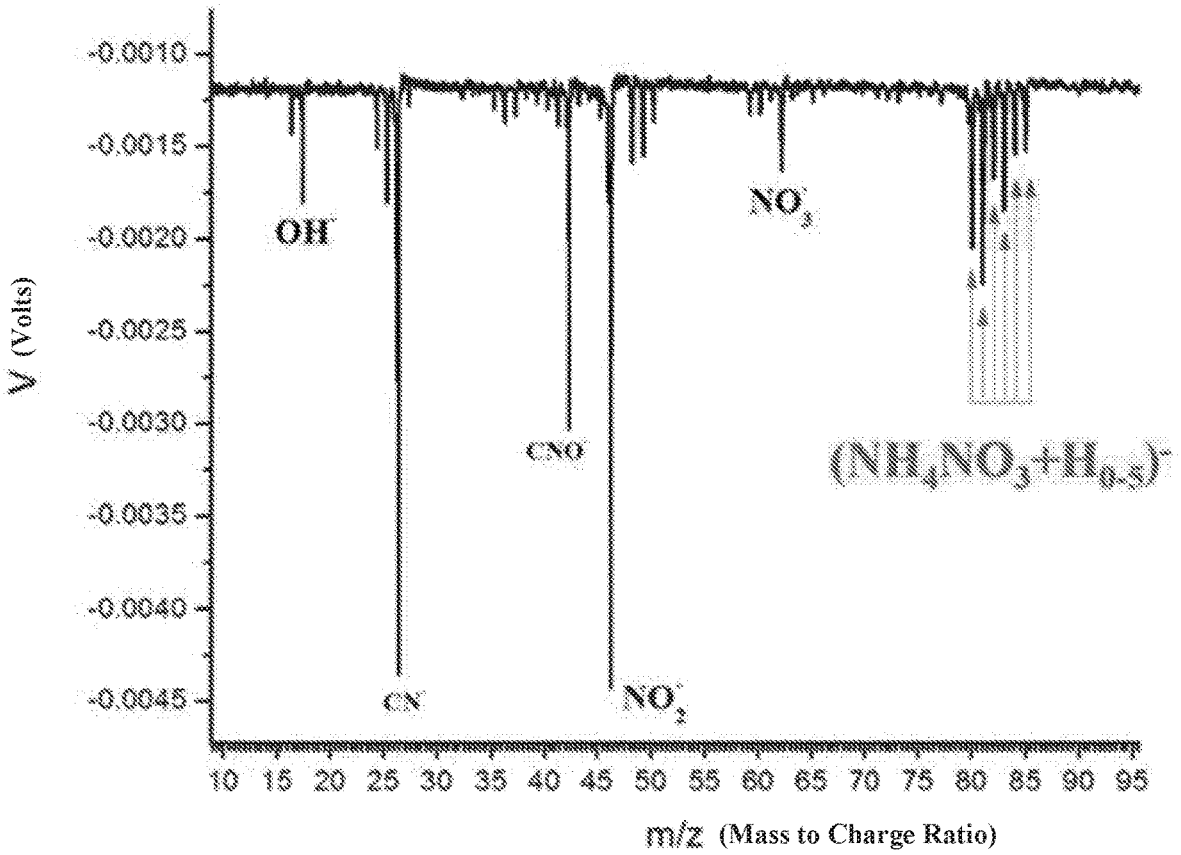
FIG. 5A shows mass spectrometry results from the laser ablation measurements of pure AN.

FIG. 5A shows mass spectrometry results from the laser ablation measurements of pure AN, indicating resultant decomposition species that were detected. Decomposition species such as $NO_x$ anions were clearly seen, which indicated decomposition and energy release accompanying the initiation of the AN itself. In addition, a series of activated complexes in the form of various protonated ammonium nitrate anions were generated, namely, $(NH_4NO_3+H_{0-5})^-$.

Figure 5B:
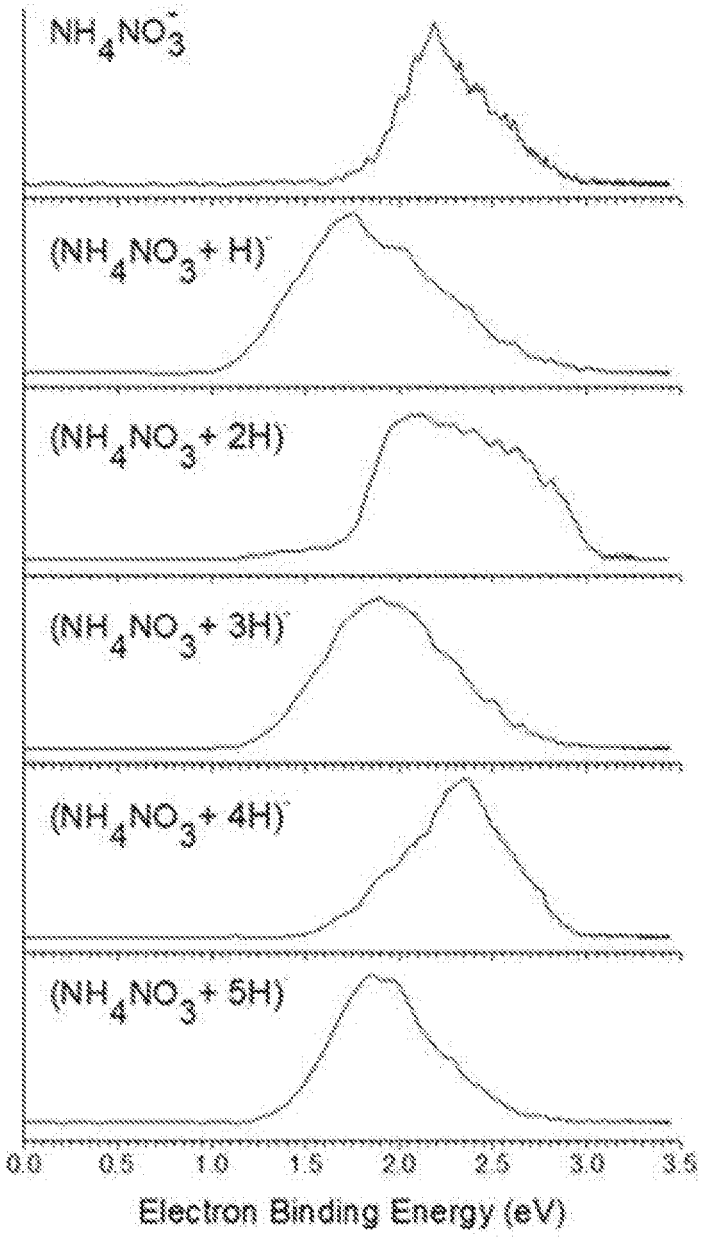
FIG. 5B shows electron binding energies determined for activated anionic complexes, which may facilitate the initiation and explosive decomposition of ammonium nitrate (AN).

FIG. 5B shows electron binding energies determined for these activated anionic complexes, which may facilitate the initiation and explosive decomposition of AN, e.g., by way of acting as transfer agents.

Essentially the same experimental setup was used for the ablation of a substrate that carried AN as well as DCM dye. More particularly, a sample of AN and DCM dye in a molar ratio of 1:2 dissolved in water was dried onto a substrate, which was wrapped onto a drum as before. Nd:YAG laser pulses with a beam diameter of 1 mm, a pulse width of 7 ns, and a pulse energy of 300 mJ were fired at the substrate wrapped around the drum as the drum was rotated; and product species corresponding to each pulse were repeatedly sampled in a time of flight mass spectrometer (TOFMS) at sampling times of 80 microseconds after laser pulse delivery.

Figure 5C:
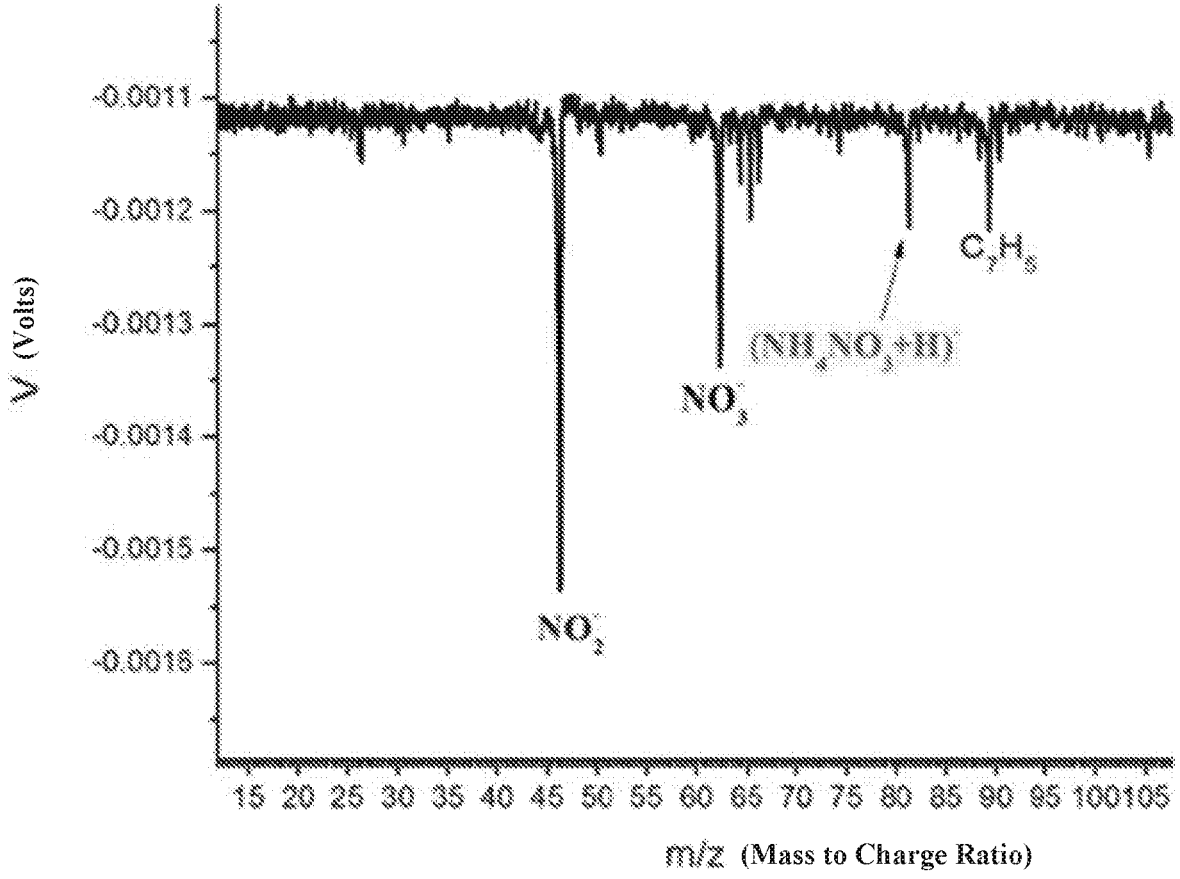
FIG. 5C shows mass spectrometry results from laser ablation measurements of AN in the presence of 4-(Dicyanomethylene)-2-methyl-6-(4-dimethylaminostyryl)-4H-pyran (DCM) dye.
Figure 5D:
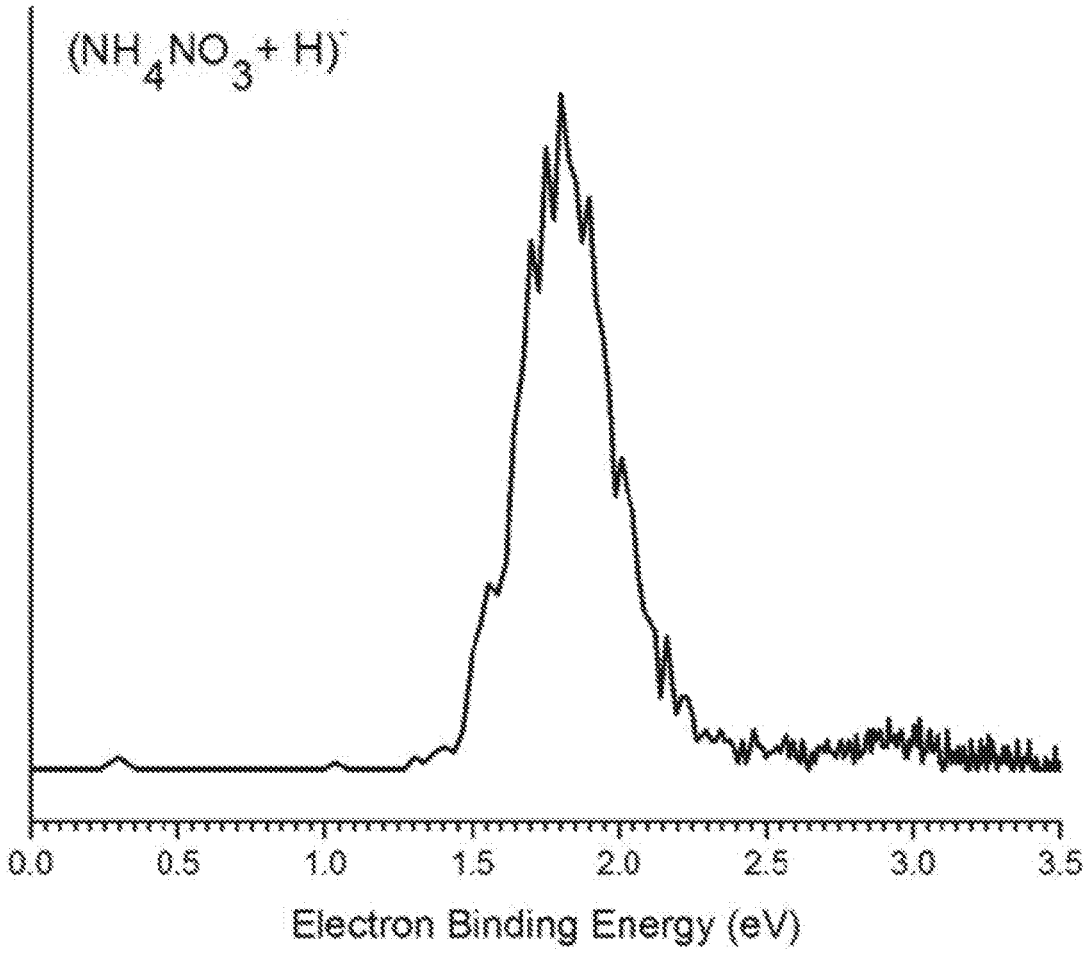
FIG. 5D shows electron binding energy determined for an activated anionic complex, which may facilitate the initiation and explosive decomposition of AN.

FIG. 5C shows mass spectrometry results from the laser ablation measurements of AN in the presence of DCM dye, indicating resultant decomposition species that were detected. Decomposition species such as $NO_x$ anions were once again clearly seen, which indicated decomposition and energy release accompanying the initiation of the AN itself. In addition, an activated complex $(NH_4NO_3+H)^-$ in the form of a singly protonated ammonium nitrate anion was generated. FIG. 5D shows electron binding energy determined for this activated anionic complex, which may facilitate the initiation and explosive decomposition of AN, e.g., by way of acting as a transfer agent.

DCM dye strongly absorbs photons at 532 nm, whereas AN photon absorption at 532 nm is relatively weak or much weaker in comparison. While unreported in the aforementioned unpublished manuscript, during the experiments involving AN combined with DCM dye, it was surprisingly observed that in response to the absorption of 532 nm laser energy at or above an optical pulse energy of approximately 1 mJ, DCM molecules themselves essentially exploded. More particularly, following their laser photoexcitation, the DCM molecules can exhibit highly forceful fragmentation in a manner that generates a shock wave, e.g., which may possibly be produced in association with deflagration properties of particular molecular photodecomposition products and/or repulsive Coulombic interactions. Such a dye molecule explosion shock wave may further facilitate the initiation, generation of a DDT in, or the detonation of the AN.

In view of the foregoing, under appropriate optical illumination conditions, the presence of a dye (e.g., DCM dye, or additionally or alternatively Rhodamine 6G) can possibly give rise to dye molecule decomposition induced shock waves within the first volume of tertiary explosive medium, thus reducing the energy input required to photokinetically initiate the first volume of tertiary explosive medium.

In embodiments in which the oxidizer salt within a volume of tertiary explosive medium to which photoexcitation is applied is AN-based, a set of illumination sources can be configured to output illumination that includes UV wavelengths such as wavelengths between 150-400 nm for exciting and/or breaking oxidizer salt chemical bonds. Additionally or alternatively, in embodiments in which the volume of tertiary explosive medium contains a transfer agent (e.g., a set of dye-based transfer agents such as DCM dye and/or rhodamine 6G dye), the set of illumination sources can be configured to output illumination having wavelengths capable of or specifically selected for exciting electronic states and/or breaking particular transfer agent chemical bonds.

The amount or relative percentage of particular transfer agent(s) incorporated into one or more portions of a volume of tertiary explosive medium under consideration that is or is intended to be subjected to photoexcitation depends upon embodiment details. For instance, in some embodiments in which portions of the photoexcited tertiary explosive medium includes an AN-based emulsion (e.g., a conventional AN-based water-in-oil emulsion) having one or more transfer agents (e.g., a dye-based transfer agent as set forth above) distributed therein, the transfer agent(s) can be present in the emulsion at 0.5-7.5%, e.g., 2-6%, by volume. Additionally or alternatively, in some embodiments in which a predetermined or first portion, region, or area of the volume of photoexcited tertiary explosive medium includes a substrate on which an oxidizer salt (e.g., AN) plus one or more transfer agents have been deposited and to which optical energy can be applied for triggering explosive initiation of the tertiary explosive medium, the molar ratio of the oxidizer salt to the transfer agent(s) can range 10000 to 0.1 depending upon embodiment details. In such embodiments, the substrate can be disposed directly adjacent to or embedded within other portions or regions of the target volume of tertiary explosive medium; and the set of illumination sources can direct optical energy to the substrate and possibly also into portions or regions of the volume of tertiary explosive medium beyond the boundaries of the substrate.

Individuals having ordinary skill in the relevant art will recognize that in general, the optical absorbance properties of a transfer agent (including optical absorbance versus optical wavelength), and in particular a dye-based transfer agent, can vary or shift depending upon the type and chemical composition of the medium or substrate that carries the transfer agent, e.g., as a result of medium-dependent shifts in transfer agent electronic states. Thus, the particular optical wavelength(s) used or selected for exciting transfer agent chemical bonds can vary depending upon the nature and chemical constituents of a tertiary explosive medium under consideration that carries the transfer agent(s) under consideration. In certain embodiments, optical wavelengths used or selected for exciting dye-based transfer agent (e.g., DCM dye) electronic states or chemical bonds and/or generating shock waves corresponding to highly forceful or explosive transfer agent molecular fragmentation or decomposition processes include one or more wavelengths between 400-700 nm (e.g., wavelengths between approximately 400-600 nm or 450-550 nm).

In general, a minimum reliable optical power level and intensity required for reliably explosively photokinetically initiating a target volume of tertiary explosive medium depends upon the chemical composition of the target volume of tertiary explosive medium under consideration, and the particular electronic states therein that are intended to be excited, preferentially excited, initially excited, broken, preferentially broken, or initially broken by the optical energy output by the set of illumination sources. More particularly, in embodiments in which the oxidizer salt within the target volume of tertiary explosive is AN-based, the optical energy delivered into the target volume of tertiary explosive medium can be at least 0.3 mJ or higher, with an optical power ranging from 0.003 to $3\times10^{11}$ W or more.

Particular Representative Photothermal Initiation and/or Detonation Apparatuses or Devices In various embodiments, an optical initiation and/or detonation apparatus or device includes or is formed as an elongate body structure having at least one lumen therein, e.g., an elongate body structure having a shape that resembles, at least generally corresponds to, or forms a housing, casing, shell, tube, or pipe (e.g., a pipe made of a metal such as stainless and/or another type of steel), and which carries or confines each of the first or proximal volume of explosive medium, the intermediate volume of explosive medium, and the second or distal volume of explosive medium. The elongate body structure can be defined to have or includes a proximal body structure portion, an intermediate body structure portion, and a distal body structure portion, where the proximal body structure portion confines the first or proximal volume of explosive medium; the intermediate body structure portion confines the intermediate volume of explosive medium; and the second or distal body structure portion confines the second or distal volume of explosive medium. In order for detonation of the second or distal volume of explosive medium to occur following and in response to photoinitation of the first volume of explosive medium, the optical body structure needs to provide sufficient confinement, in a manner readily understood by individuals having ordinary skill in the relevant art.

The proximal body structure portion is structurally and optically couplable or coupled to or interfaceable or interfaced with an optical subsystem or unit, which is electronically couplable or coupled to, or interfaceable or interfaced with, an electronics subsystem or unit. In several embodiments, the optical subsystem or unit and the electronics subsystem or unit are provided or carried by a single electronics and optical assembly that includes a power source, and which is couplable or mountable or coupled or mounted to or integrated with the body structure portion, e.g., such that the entire electronics and optical assembly along with the body structure portion forms a single or self-contained device or unit that can be placed in a borehole or blasthole. In other embodiments, at least portions of the power supply, the electronics subsystem, and the optical subsystem are remote from the body structure portion. Remote optical elements can be optically coupled to deliver or apply optical energy into the first or proximal volume of explosive medium within the proximal body structure portion by way of a set of optical fibers and possibly one or more lenses, as further elaborated upon below.

Figures 6A, 6B:
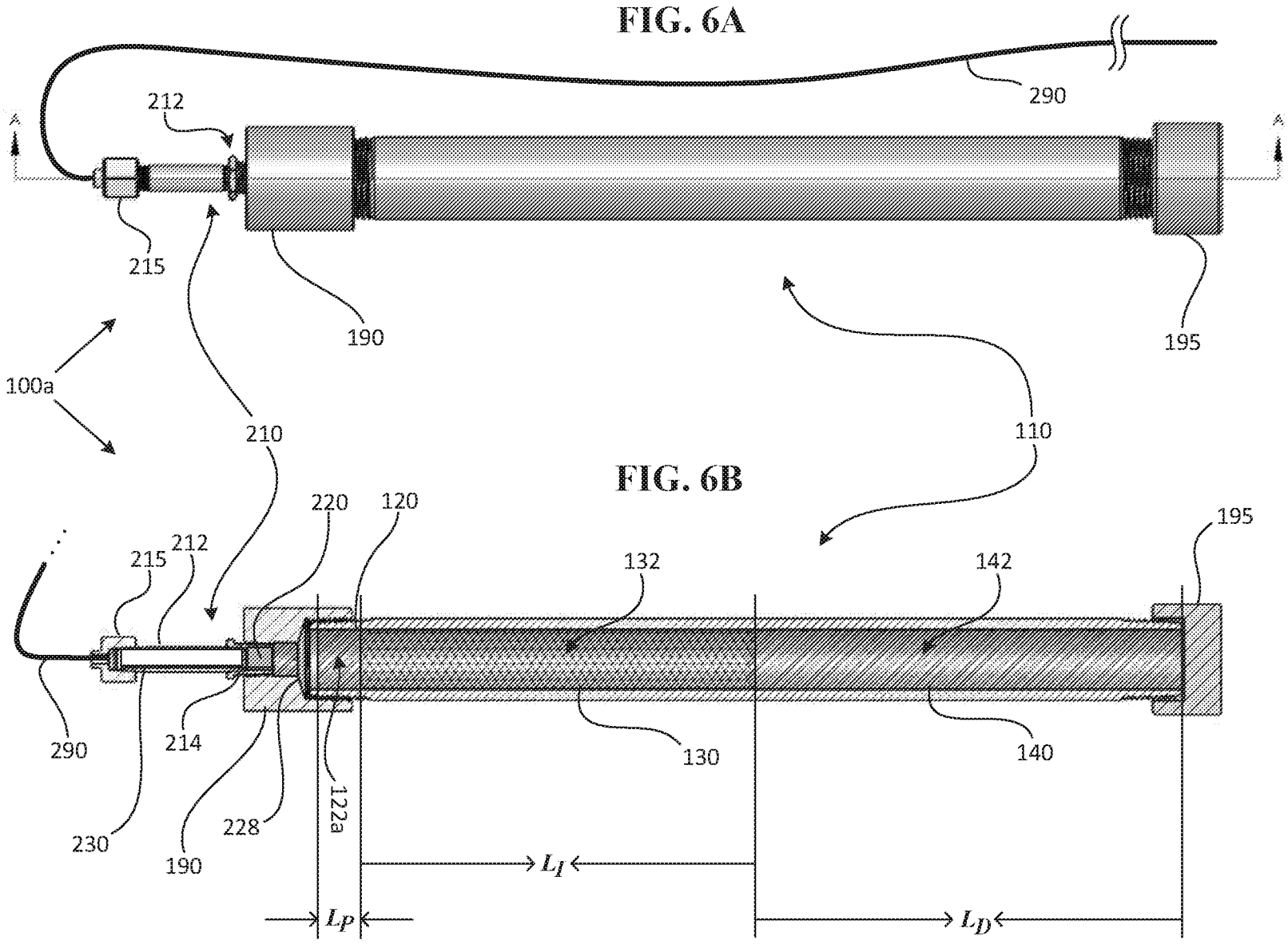
FIG. 6A shows a side schematic illustration of an optical initiation and/or detonation device in accordance with certain representative embodiments of the present disclosure.
FIG. 6B is a cross sectional schematic illustration of the device of FIG. 6A, taken along cross section A-A of FIG. 6A, where a body structure of the device carries a first or proximal volume of bitumen-containing explosive medium.

FIG. 6A shows a side schematic illustration of an optical initiation and/or detonation device 100*a* in accordance with certain representative embodiments of the present disclosure; and FIG. 6B is a cross sectional schematic illustration of the device 100*a* of FIG. 6A, taken along cross section A-A of FIG. 6A. In an embodiment, the optical initiation and/or detonation device 100*a* includes a body structure 110 in the form of a tube or pipe having a wall providing a thickness and defining an outer diameter, an inner diameter; and a lumen therein or therethrough, which carries each of the first or proximal volume of explosive medium, the intermediate volume of explosive medium, and the second or distal volume of explosive medium. More particularly, the body structure 110 can be defined to include a proximal body portion 120 that carries the first or proximal thermal absorber containing, e.g., bitumen-containing, volume of explosive medium 122*a* across a length $L_P$; an intermediate body portion 130 that carries the intermediate volume of explosive medium 132 across a length $L_I$; and a distal body portion 140 that carries the second or distal volume of explosive medium 142 across a length $L_D$. In various embodiments, though not necessarily all embodiments, $L_P$ is less than $L_I$ and/or $L_D$, e.g., significantly less than each of $L_1$ and $L_D$. in some embodiments. In multiple embodiments, $L_P$ is approximately 5-85%, 10-75%, less than 50-60%, less than 35%, or less than 25% of the length of $L_I$ and/or $L_D$, depending upon embodiment details. However, the length of each of $L_P$, $L_I$, and $L_D$ and/or the relative lengths among $L_P$, $L_I$, and $L_D$ depend upon the type(s), compositions, and properties of explosive media under consideration for each of the first or proximal volume of explosive medium, the intermediate volume of explosive medium, and the second or distal volume of explosive medium, in a manner that individuals having ordinary skill in the relevant art will recognize.

The body structure 110 also includes a distal end fitting or cap 195 sealing a distal end of the distal body portion 140, which provides an appropriate pressure seal in a manner that individuals having ordinary skill in the relevant art will understand. In alternate embodiments, the body structure 110 can be a unitary shell-type or tube-type structure, which does not need an end cap, e.g., which is sealed at a distal end thereof.

The optical initiation and/or detonation device 100*a* further includes an electronics and optical assembly 210 providing an electronics and optical subsystem 220, which includes a set of optical sources such as one or more laser diodes, and associated electronics for powering and controlling the set of optical sources, e.g., power management and control circuitry. The set of optical sources is optically coupled to portions of the first or proximal volume of explosive medium by way of a set of optical elements such as at least one lens system or lens configured for receiving and focusing the optical energy output by the set of optical sources, and an optical window 228, e.g., a sapphire window. The electronics and optical assembly 210 further includes a power source 230 such as a battery. The electronics and optical assembly 210 resides in a housing 212, which is structurally coupled or joined to the body structure 110 by way of one or more fittings, such as a first fitting 190 and a second fitting 212, which can carry conventional screw threads. The electronics and optical assembly 210 is further coupled to a control signal line 290 by way of another fitting 215, which can also carry conventional screw threads.

Particular non-limiting representative experimental examples in accordance with embodiments of the present disclosure are now described in detail hereafter.

Example 1

Figure 6C:
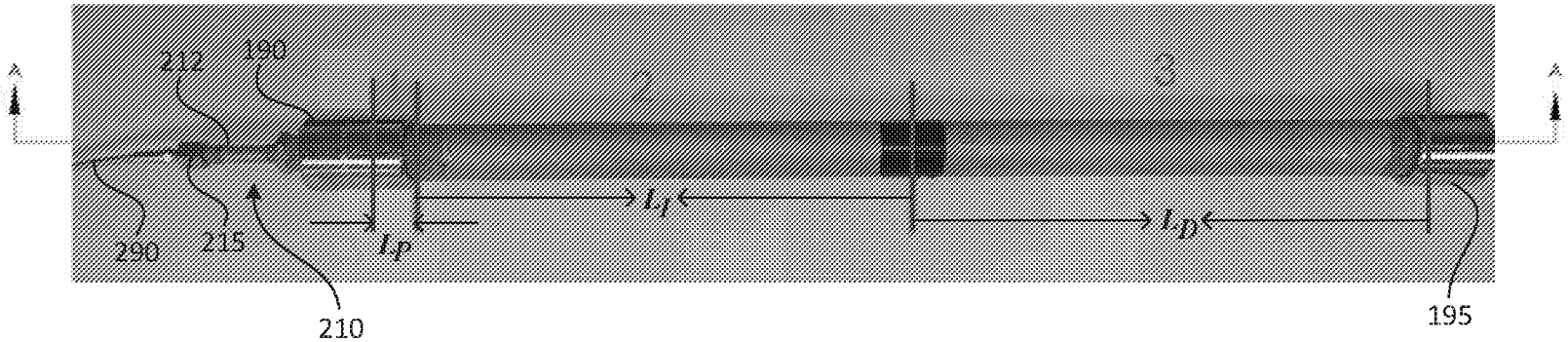
FIG. 6C shows an image of a first representative implementation of the optical initiation and/or detonation device of FIG. 6A

FIG. 6C shows an image of a first representative implementation of the optical initiation and/or detonation device 100*a* of FIG. 6A. The electronics and optical assembly 210 of the first representative implementation of the optical initiation and/or detonation device included a commercially available 46 W fiber coupled diode laser having a center wavelength of 808 nm, where the fiber coupling was provided by an optical fiber having a 400 micron core; and a lens system, producing a beam diameter of 330 μm and outputting an optical intensity of $5.8\times10^8$ W/m$^2$. The fiber coupled diode laser was operated in continuous wavelength (CW) mode. A suitable fiber coupled diode laser is available from a commercial supplier such as LIMO (LIMO GmbH, Dortmund, Germany), for instance, a LIMO25-F100-DL808 high power diode laser, which has a CW output power of at least 25 W, and a center wavelength of 805-810 nm.

Within the proximate body section portion 120, the intermediate body section portion 130, and the distal body section portion 140, the first representative implementation of the optical initiation and/or detonation device 100 respectively carried first or proximate, intermediate, and second or distal volumes of explosive media formulated as detailed hereafter.

(1) first or proximate volume of bitumen-containing explosive medium 122*a*, in terms of relative weight percentages: an initial formulation having 62.6% ammonium nitrate; 8.9% sodium nitrate; 10.2% sodium perchlorate; 9.8% water; 2.3% E476 emulsifier; 2.7% diesel oil; and 3.4% bitumen, where 95.9% of the initial formulation was combined with 4.1% K-20 glass microballoons to define a final formulation;

(2) intermediate volume of explosive medium 132, in terms of relative volume percentages: 95% nitromethane (NM) plus 5% ethylenediamene (EDA); and (3) second or distal volume of explosive medium 142: identical to the first or proximate volume of explosive medium.

In this first representative implementation, the proximal body section portion 120 had a length $L_P$ of approximately 5.54 cm (2.18 inches), and carried approximately 28 milliliters (mL) of the first volume of bitumen-containing explosive medium 122*a*; the intermediate body section portion 130 had a length $L_1$ of approximately 30.48 cm (12.00 inches), and carried approximately 154 mL of the second volume of NM/EDA (95%/5%) explosive medium 132; and the distal body section portion 140 had a length $L_D$ of approximately 30.48 cm (12.00 inches), and carried approximately 154 mL of the second or distal volume of bitumen-containing explosive medium 142. The inner diameter of the body section 120 was approximately 2.54 cm (1.00 inch) along its length.

Multiple tests in a blast chamber were conducted on the first representative implementation of the optical initiation and/or detonation device 100*a*, and each such test resulted in successful optical initiation of the first or proximate volume of bitumen-containing explosive medium 122*a*, and successful detonation of the second or distal volume of explosive medium 142 by way of generation of a DDT in the intermediate volume of explosive medium 132.

Figure 6D:
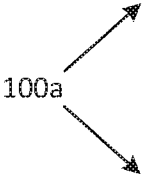
FIG. 6D is an image showing post-detonation fragments of the first representative implementation of the optical initiation and/or detonation device of FIG. 6C after detonation thereof.
Figure 6D:
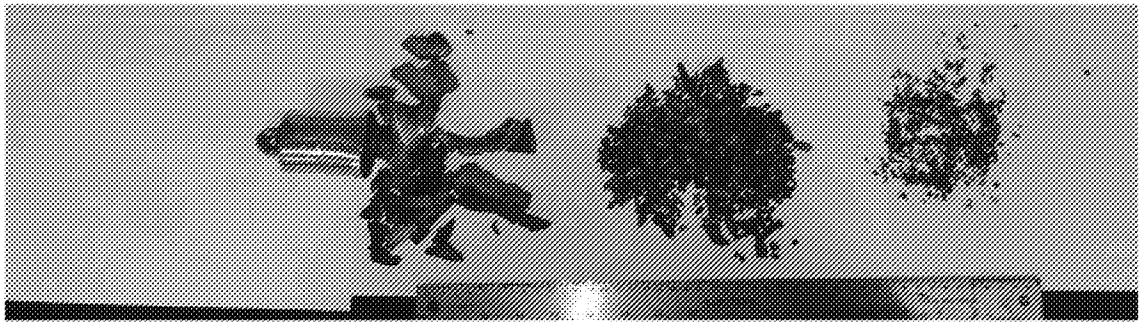

FIG. 6D is an image showing post-detonation fragments of the first representative implementation of the optical initiation and/or detonation device 100*a* after detonation of the second or distal volume of explosive medium 142 therein. As indicated in FIG. 6D, regions of the body structure 110 corresponding to the proximal body structure portion 120 showed evidence of strong or very strong rupture; other regions of the body structure 110 corresponding to the intermediate body structure portion 130 and the distal body structure portion 140 showed evidence of significant or very significant small or very small shrapnel generation. It can be noted that the smallest pieces of shrapnel most likely were produced as a result of the detonation of the second or distal volume of explosive medium contained in the distal body structure portion 140, as no evidence of fragments or shrapnel that could be directly correlated with the structure of the end cap 195 were found; and larger pieces of shrapnel most likely were produced as a result of the generation of a DDT within the intermediate volume of explosive medium contained in the intermediate body structure portion 130.

Additional Representative Embodiments

(A) AN Based Emulsion Explosive Medium Plus Bitumen, and an Optical Beam Expander Further to the aforementioned open air combustion experiments conducted on test samples of AN based emulsion explosive media plus bitumen that were carried out with a 35 W, 4,100 lumen white light source, the inventors named on the present application tested the initiation characteristics of additional test samples versus illumination area, by placing an iris between the illumination source and the test samples.

Figure 7A:
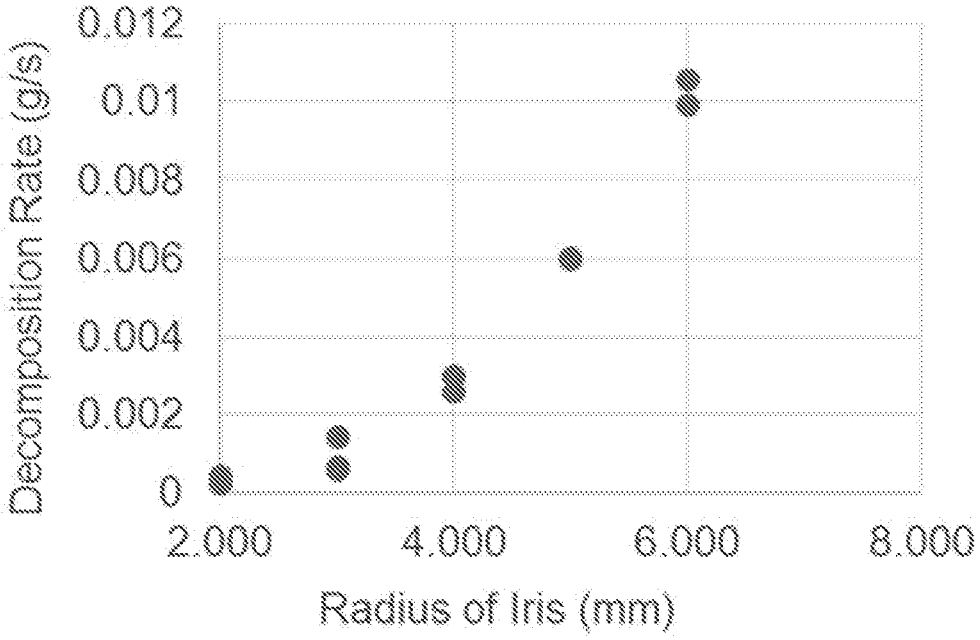
FIG. 7A is a graph showing a test sample decomposition rate in grams per second (g/s) versus iris radius (mm) for experiments directed to combustion of bitumen-containing AN in open air by way of white light output by using a 30 Watt (W), 4,100 lumen handheld flashlight having a halogen bulb.

FIG. 7A is a graph showing test sample decomposition rate in grams per second (g/s) versus iris radius (mm). As indicated in FIG. 7A, a larger beam radius (or equivalently, a larger beam diameter) enhances the test sample decomposition rate, indicating that increased beam diameter enabled faster reaction rates associated with photothermal processes in the test samples. Based on the results of FIG. 7A, the inventors named on the present application designed an optical initiation and/or illumination device 100*a* having an optical beam expander.

Figure 7B:
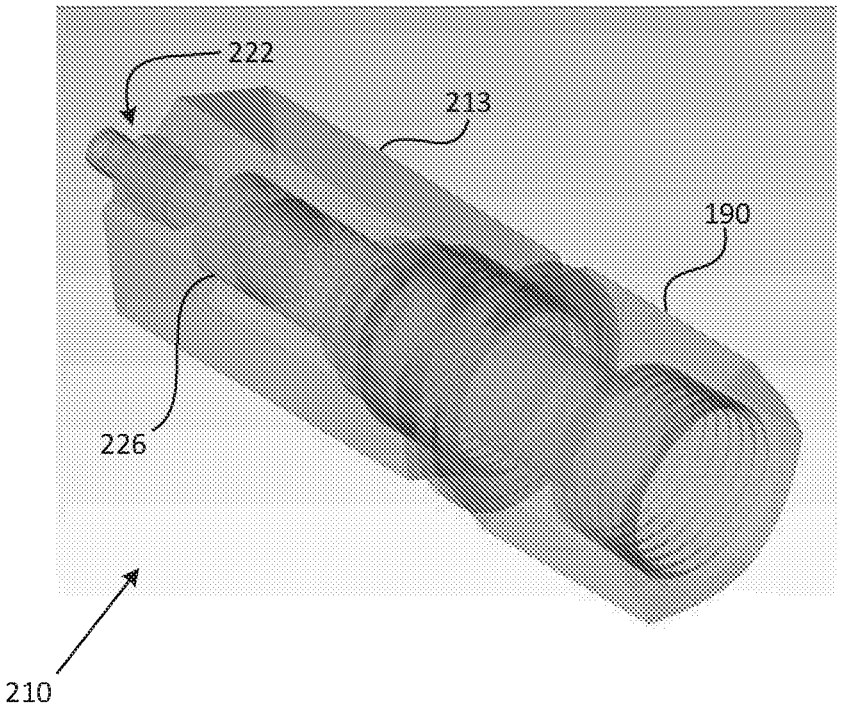
FIG. 7B is a perspective internal schematic illustration showing particular representative portions of an optical subsystem within an electronics and optical assembly of an optical initiation and/or detonation device having a beam expander 226 in accordance with an embodiment of the present disclosure.

FIG. 7B is a perspective internal schematic illustration showing particular representative portions of an optical subsystem within an electronics and optical assembly 210 of an optical initiation and/or detonation device 100*a*, which includes a beam expander 226 that receives a beam of light output from a fiber coupled diode laser 222, and outputs an expanded beam that is delivered into portions of the first volume of explosive medium in accordance with an embodiment of the present disclosure. The beam expander 226 can include or be a sapphire rod that replaces the sapphire window 228 shown in FIG. 6B, and can be carried within an associated beam expander fitting 213 that is structurally configured for mating engagement with the first fitting 190 that joins the electronics and optical assembly 210 to the body structure 110.

Figure 7C:
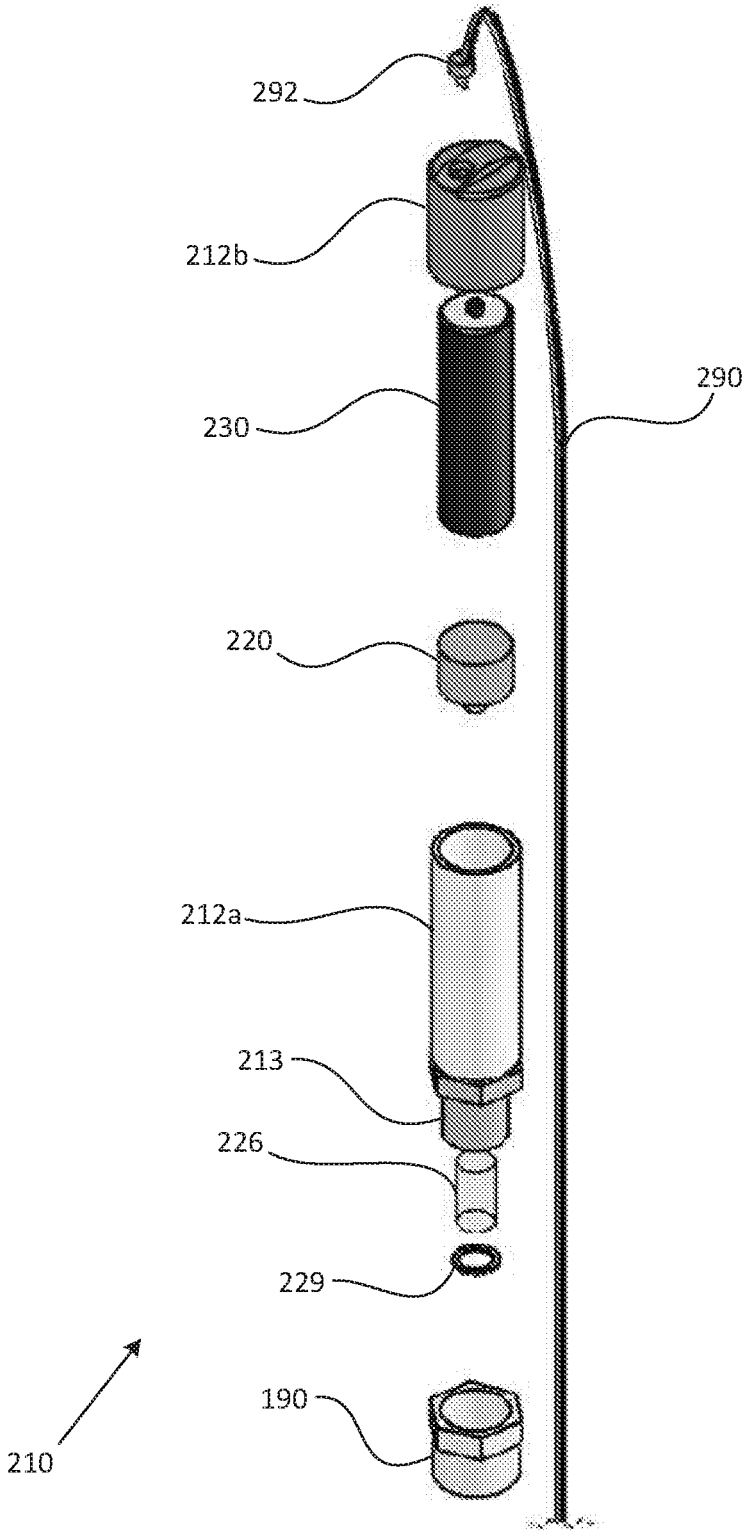
FIG. 7C is a perspective exploded schematic illustration providing further details of the electronics and optical assembly of FIG. 7B.

FIG. 7C is a perspective exploded schematic illustration providing further details of such an electronics and optical assembly 210, showing the beam expander 228 and its associated beam expander fitting 213, which reside adjacent to a first portion 212*a* of the electronics and optical assembly's housing 212. A sealing element 229 such as an o-ring ensures an appropriate pressure seal between the beam expander 228, the beam expander fitting 213, and the first fitting 190, in a manner readily understood by individuals having ordinary skill in the relevant art. The electronics and optical subsystem 220 is disposed between the beam expander 226 and the battery 230 within the first portion 212*a* of the housing 212. A second portion 212*b* of the housing 212 forms a cap that covers one end of the battery 230. As also indicated in FIG. 7C, a connector element 292 that is structurally configured for engagement with the cap 212*b* couples the electronics and optical subsystem 220 to the control signal line 290.

Figure 7D:
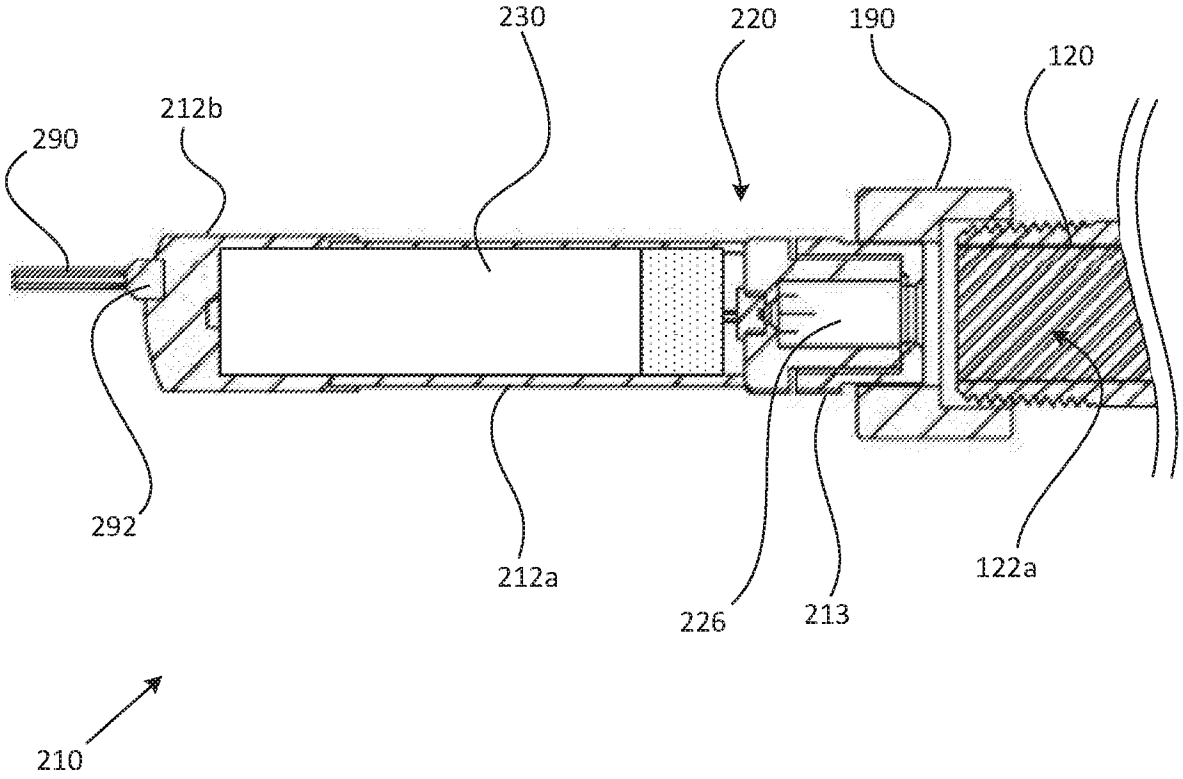
FIG. 7D is a side schematic illustration showing further aspects of an electronics and optical assembly corresponding to FIG. 7C in accordance with an embodiment of the present disclosure.

FIG. 7D is a side schematic illustration showing further aspects of an electronics and optical assembly 210 corresponding to FIG. 7C in accordance with an embodiment of the present disclosure, including a manner by which the electronics and optical assembly 210 is couplable or coupled to the body structure 110.

Figure 7E:
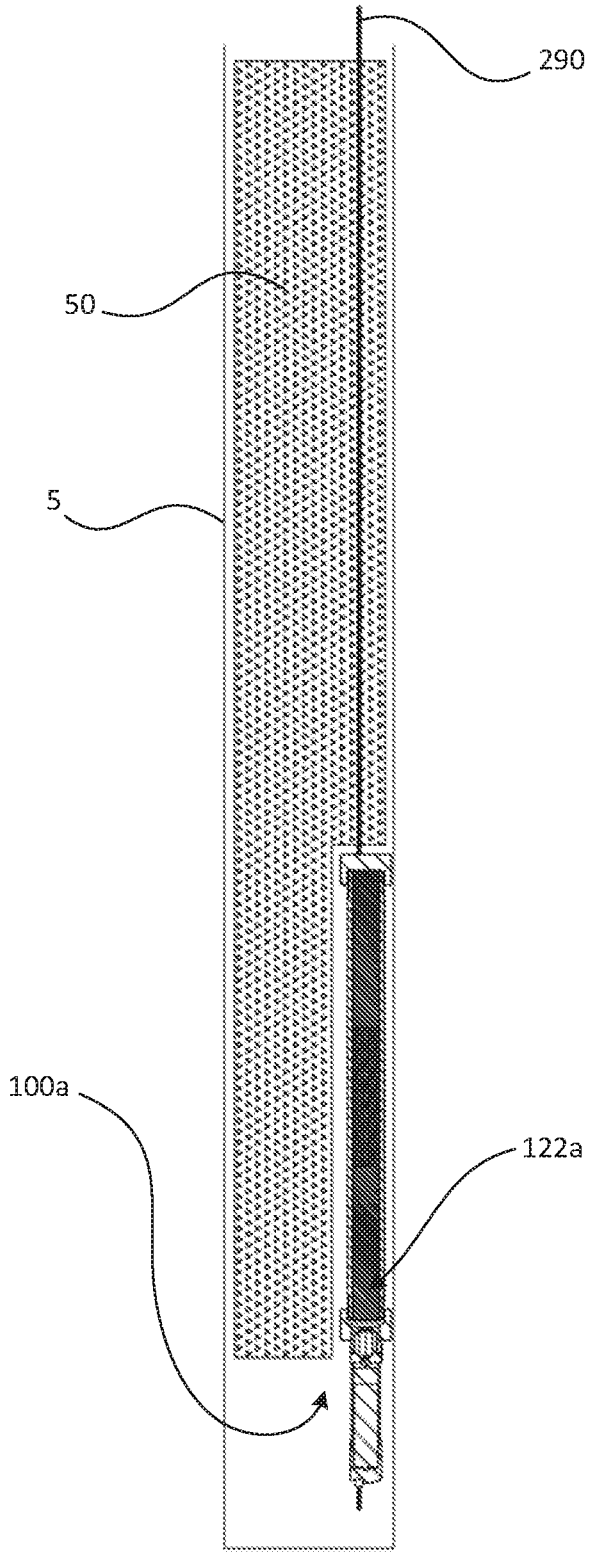
FIG. 7E is a cutaway illustration showing a representative optical initiation and/or detonation apparatus or device disposed in a borehole or blasthole, wherein at least portions of the borehole contain a tertiary explosive medium along its length, external to the optical initiation and/or detonation device.

FIG. 7E is a cutaway illustration showing a representative optical initiation and/or detonation apparatus or device 100*a* disposed in a borehole or blasthole 5 (e.g., a conventional borehole, such as at a mine site) having a length, a cross sectional area, and an opening, wherein at least portions of the borehole contain a tertiary explosive medium 50 (e.g., an AN based emulsion explosive medium) along its length, external to the optical initiation and/or detonation device 100*a*. Photoinitation of the first volume of bitumen-containing explosive medium 122*a* within the photoinitiation device 100*a* can give rise to subsequent detonation of the second volume of explosive medium 142 within the photoinitation device 100*a*, which can give rise to subsequent detonation of the tertiary explosive medium 50 along portions of the borehole's length, in a manner readily understood by individuals having ordinary skill in the relevant art.

Example 2

A second representative implementation of the optical initiation and/or detonation device 100*a* was constructed, where this second representative implementation was identical to the first representative implementation described above, with the exception that the sapphire window 228 was replaced with the beam expander 226 in the manner set forth above with respect to FIGS. 7A and 7B. Hence, compared to the first representative implementation of the optical initiation and/or detonation device 100*a*, the second representative implementation of the optical initiation and/or detonation device 100*a* delivered an optical beam having a significantly larger or expanded cross sectional area into the first or proximal volume of explosive medium.

The beam expander 226 output an expanded illumination beam having a diameter of 8,500 μm, and an optical intensity of $1.86\times10^6$ W/m$^2$. Testing in a blast chamber revealed that the second representative implementation of the optical initiation and/or detonation device 100*a* initiated the first volume of bitumen-containing explosive medium 122*a* at least as or essentially as effectively as the first representative implementation of the optical initiation and/or detonation device 100*a*, indicating that the beam expander 226 can be employed in various embodiments in accordance with the present disclosure.

(B) AN Based Emulsion Explosive Medium Plus Carbon Black Instead of Bitumen

As indicated above, the first volume of explosive medium can utilize one or more other types of thermal absorbers instead of bitumen. For instance, in specific embodiments, the first volume of explosive medium can include or be an AN based emulsion explosive medium having carbon black therein. However, the inventors named on the present application have found that carbon black is less or significantly less effective or efficient than bitumen with respect to aiding or enabling initiation of photonically irradiated AN based emulsion explosive media, and thus different drive parameters are utilized for the set of illumination sources (e.g., different laser operating parameters), or a more complex and powerful set of illumination sources and/or elements is employed in such embodiments. For instance, the set of illumination sources and/or elements can include a LIMO model HLU30F-400-808 fiber coupled laser diode array, which has an optical center wavelength of 808 nm and provides up to 60 W of optical power, where laser diode array to optical fiber coupling is by way of a 400 micron diameter fiber, which gives a maximum optical power density of 50 kW/cm$^2$.

In a representative embodiment in which the first volume of explosive medium provides an AN based emulsion explosive composition having carbon black distributed in at least portions thereof that are intended to be exposed to photonic irradiation, the first volume of explosive medium can be formulated, with respect to relative weight percentages of its components, as 71.93% AN; 10.27% sodium nitrate; 11.52% water; 1.55% mineral oil; 0.28% wax BeSquare 195 wax (Baker Hughes, a GE Company, Houston, Tex. USA); 0.54% Polywax (Baker Hughes; or Sigma-Aldrich, St. Louis, Mo., USA); 2.51% LZ2824s surfactant/emulsifier; 0.51% Arlacel 83N sorbitan sesquioleate non-ionic surfactant, and 0.99% carbon black.

The second volume of explosive medium can be compositionally identical to or different than the first volume of explosive medium, e.g., the second volume of explosive medium can include or be an AN based emulsion explosive medium formulated in accordance with constituents set forth above, and/or the can include sensitizing agents that the first volume of explosive medium need not or does not contain, such as glass microballoons.

Particular Representative Photokinetic Initiation and/or Detonation Apparatuses or Devices Devices Carrying First/Proximal, Intermediate, and Second or Distal Volumes/Explosive Media In a manner analogous to that described above with respect to FIGS. 6A-6B, a photokinetic initiation and/or detonation apparatus or device can contain or confine a first volume of explosive medium that lacks a thermal absorber, such as an AN based emulsion explosive medium in which no thermal absorber is present.

Figure 8:
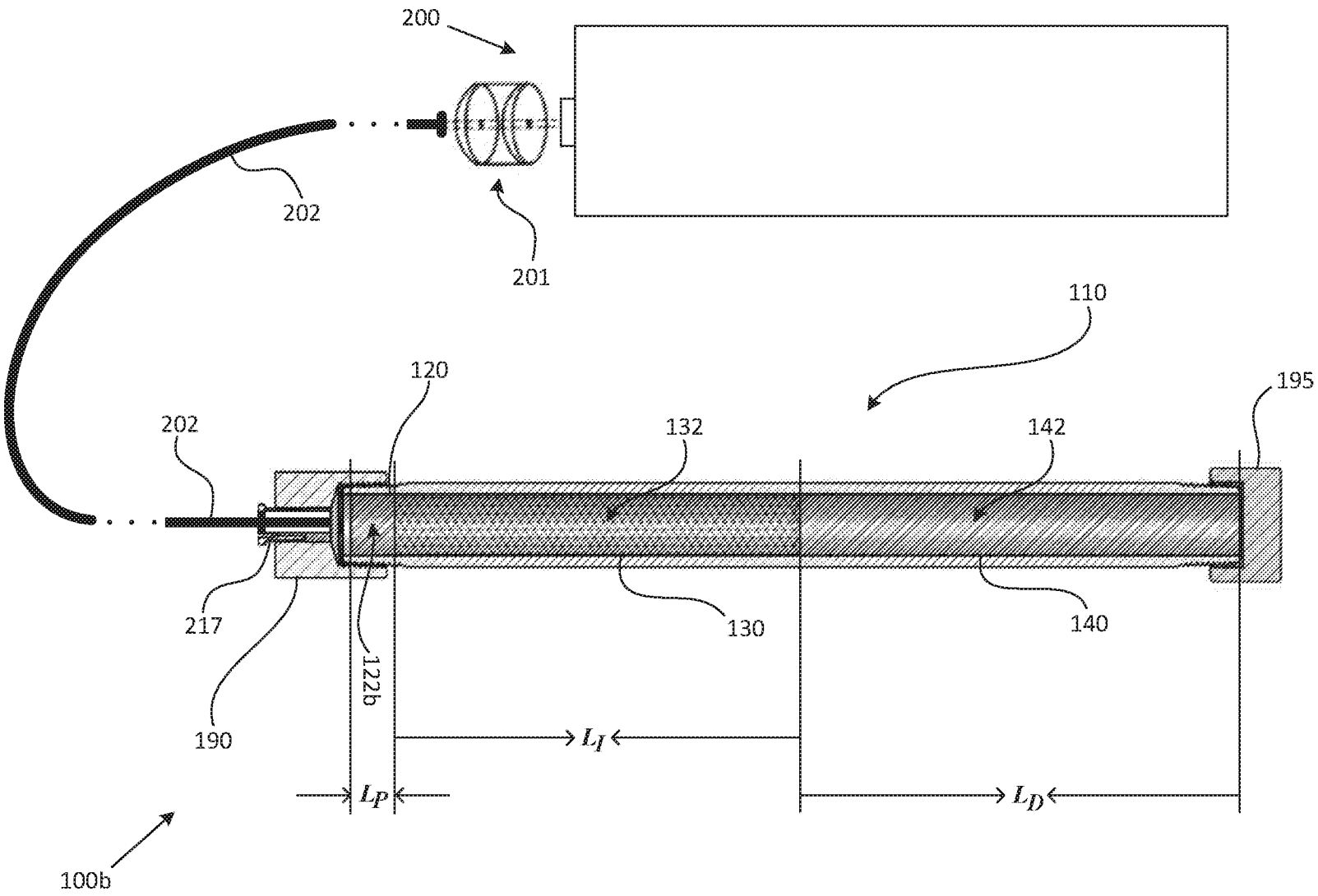
FIG. 8 is a schematic side view showing a representative photokinetic initiation and/or detonation apparatus or device in accordance with an embodiment of the present disclosure, which includes a body structure as set forth above with respect to FIG. 6B, and which contains in its first body structure portion a first or proximate volume of thermal-absorber-free explosive medium instead of the first or proximate volume of bitumen-containing explosive medium shown in FIG. 6B.

FIG. 8 is a schematic side view showing a representative photokinetic initiation and/or detonation apparatus or device 100*b* in accordance with an embodiment of the present disclosure, which includes a body structure 110 as set forth above with respect to FIG. 6B, and which contains in its first body structure portion 120 a first or proximate volume of thermal-absorber-free explosive medium 122*b* instead of the first or proximate volume of bitumen-containing explosive medium 122*a* shown in FIG. 6B.

The photokinetic initiation and/or detonation device 100*b* is optically couplable or coupled to a remote laser system 200 such as a high power excimer laser system, e.g., a XeCl excimer laser system, which can include or be a Coherent Leap 300C or a Coherent Vyper Series laser, e.g., a TriVyper laser (Coherent, Inc., Santa Clara, Calif., USA) by way of a transfer lens 201, and possibly further by way of a set or array of optical fiber bundles 202. The transfer lens 201 focus the beam(s) output by the XeCl laser system 200 to a suitable or appropriate spot size for delivery into the photokinetic initiation and/or detonation device 100*b*. Such a transfer lens 201 is described in "Polymer ablation with a high-power excimer laser tool," G. E. WOlbold, C. L. Tessler, and D. J. Tudryn, *Microelectronic Engineering* 20 (1995), pp. 3-14.

Additional/Other Devices

As indicated above, in multiple embodiments a volume or target volume of tertiary explosive medium can reside within a housing, or shell structure, which can be an enclosure made of a metal (e.g., stainless steel) or polymer material, and which enhances the confinement of the target volume of tertiary explosive medium.

FIGS. 9A-9D are illustrations of particular non-limiting representative embodiments of shells 111 in which a target volume of tertiary explosive medium 150 is confined for facilitating the initiation thereof or generation of a DDT therein. In some embodiments, the target volume of tertiary explosive medium 150 includes a transfer agent, but this need not be the case in all embodiments (i.e., in certain embodiments, the target volume of tertiary explosive medium 150 excludes or lacks a transfer agent). In each such embodiment, optical energy is coupled into the target volume of tertiary explosive medium 150 by way of the set of illumination sources 200, typically or optionally in combination with an optical interface structure 250 (e.g., which includes one or more lens elements). Individuals having ordinary skill in the relevant art will understand that a seal (e.g., an elastomer seal, such as by way of an o-ring) is provided between the optical interface structure 250 and the shell 111, such that pressure loss between the inside of the shell 111 and the outside of the shell 111 during the initiation of the target volume of tertiary explosive medium is minimized, avoided, or prevented.

Optical energy can be delivered to or into predetermined portions of the confined target volume of tertiary explosive medium 150 using an optical power and optical intensity sufficient for explosively initiating at least one area or region of the target volume of tertiary explosive medium 150 having the diameter of a propagating shock wave.

Figure 9A:
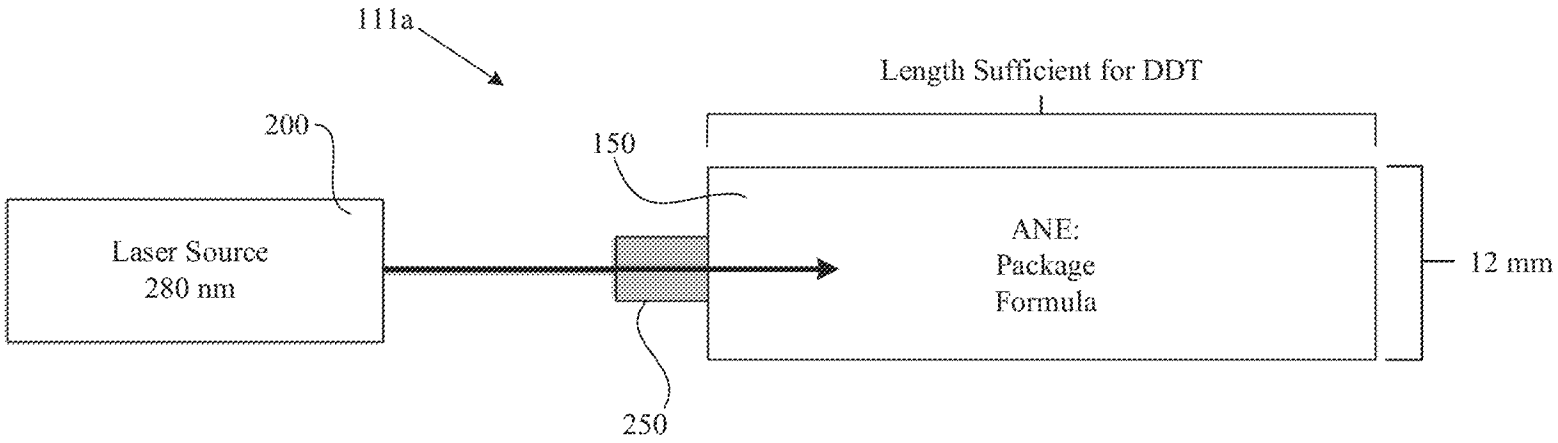
FIGS. 9A-9D are illustrations of particular non-limiting representative embodiments of shells in which a target volume of tertiary explosive medium is confined for facilitating the initiation thereof or generation of a DDT therein.
Figure 9B:
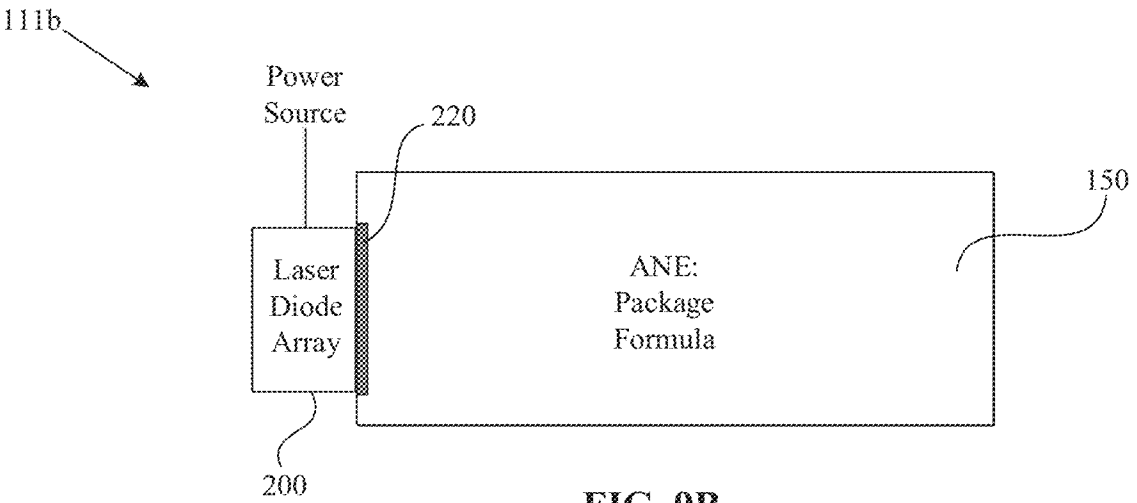
Figure 9C:
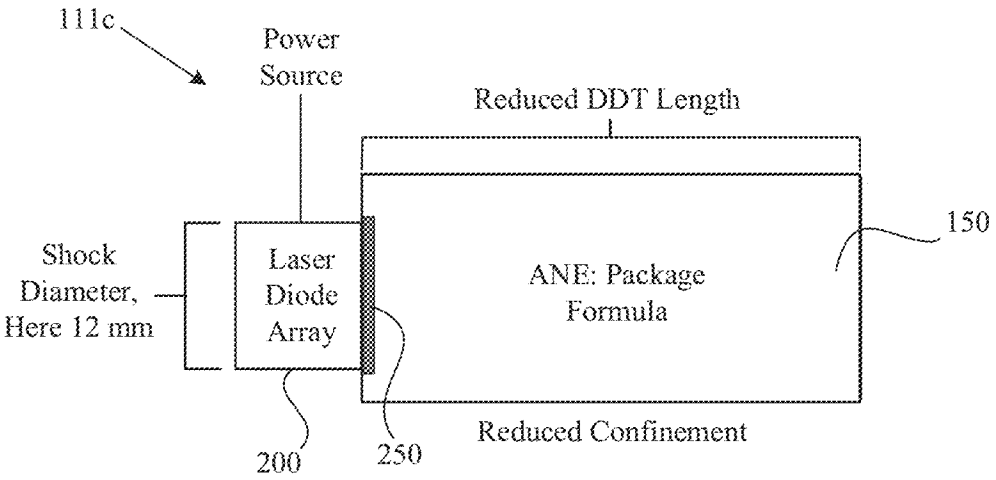
Figure 9D:
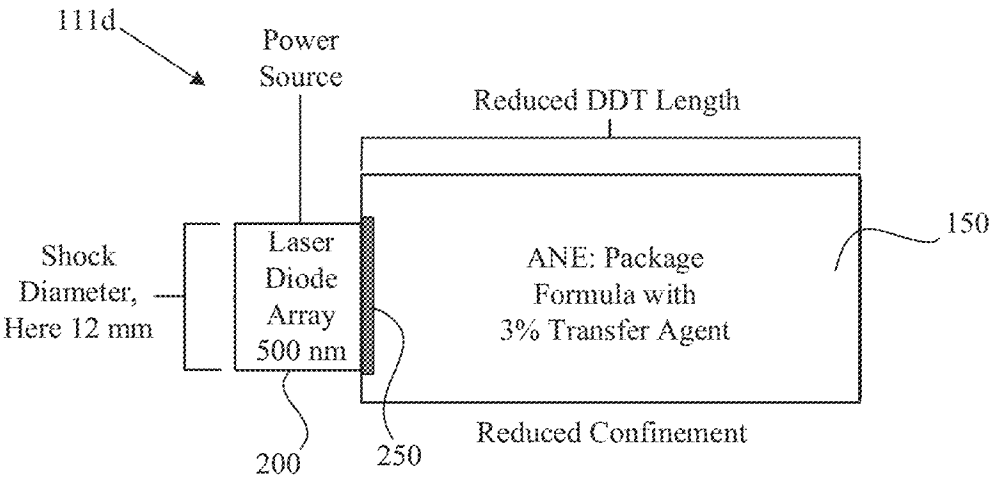

In the embodiment shown in FIG. 9A, the target volume of tertiary explosive medium 150 is confined within a shell 111 having a diameter of 12 mm, and a length sufficient for enabling a DDT to occur within the shell 111. This length can be, for instance, 30 to 60 mm. A laser source 200 that resides external to a borehole 5 in which the shell 111 resides is configured for outputting light having a centre wavelength of 280 nm. Optical energy output by the laser source 200 can be delivered or directed into particular portions of the target volume of tertiary explosive medium 150 inside the shell 111, across a predetermined free space distance and/or through a predetermined length of optical fibre or light guide, and typically through a lens or lens assembly 250.

The embodiment of the shell 111*b* shown in FIG. 3B utilizes a Nd:YAG laser 200 that is optically coupled to or mated or integrated with portions of the shell 105*b*, such as by way of optical fibre(s). The laser source 200 can include or be a laser head configured for outputting light having a centre wavelength of 532 nm, and a pulse energy level of approximately 1 mJ or higher depending upon embodiment details (e.g., between approximately 1-1500 mJ, depending upon the laser source 200 under consideration and/or the composition of the target volume of tertiary explosive medium 100). A lens assembly or unit 250 can be provided between the laser diode array 200 and the shell 111*b*. The shell 111*b* shown in FIG. 3B may need to be longer than the shell 111*a* shown in FIG. 3A, or may be shorter than the shell 111*a* of FIG. 3A, depending upon embodiment details. More particularly, the characteristics of the set of illumination sources 200 and the optical interface 250, in association with the specific geometry of the shell 111 and the composition of the target volume of tertiary explosive medium 150 affect the shell length required for generating a DDT in the target volume of tertiary explosive medium 150. Thus, the use of one or more particular types of optical energy sources 200, and the characteristics of any optical interface(s) 250 appropriate therefor, can affect or alter the length of the shell 111. For instance, FIG. 3C shows a representative embodiment of a shell 111*c* having a reduced DDT length compared to the shell 111*b* of FIG. 3B, with 12 mm diameter.

When the target volume of tertiary explosive medium 150 carries a transfer agent such as DCM dye or rhodamine 6G dye, the optical energy delivered into the target volume of tertiary explosive medium 150 can include or be optical wavelengths that specifically excite electronic states and/or break chemical bonds within the transfer agent (e.g., in addition or as an alternative to optical wavelengths that specifically excite electronic states and/or break chemical bonds within the oxidizer salt). Moreover, as previously described, such optical energy can be delivered to dye molecules at an optical power and intensity sufficient to cause a type of dye molecule explosion, i.e., highly forceful dye molecule fragmentation that generates an accompanying shock wave. Such photochemical effects caused by the photoexcitation of the transfer agent can also reduce or further reduce the length required for the generation of a DDT in the target volume of tertiary explosive medium 150. Consequently, in embodiments in which the target volume of tertiary explosive medium 150 includes one or more transfer agents, the length of the shell 111 can be reduced or further reduced, e.g., by 20-50%, compared to at least some embodiments that lack the transfer agent(s). For instance, FIG. 3D illustrates a shell 111*d* having a (further) reduced DDT length in accordance with a non-limiting representative embodiment of the present disclosure.

Figure 10A:
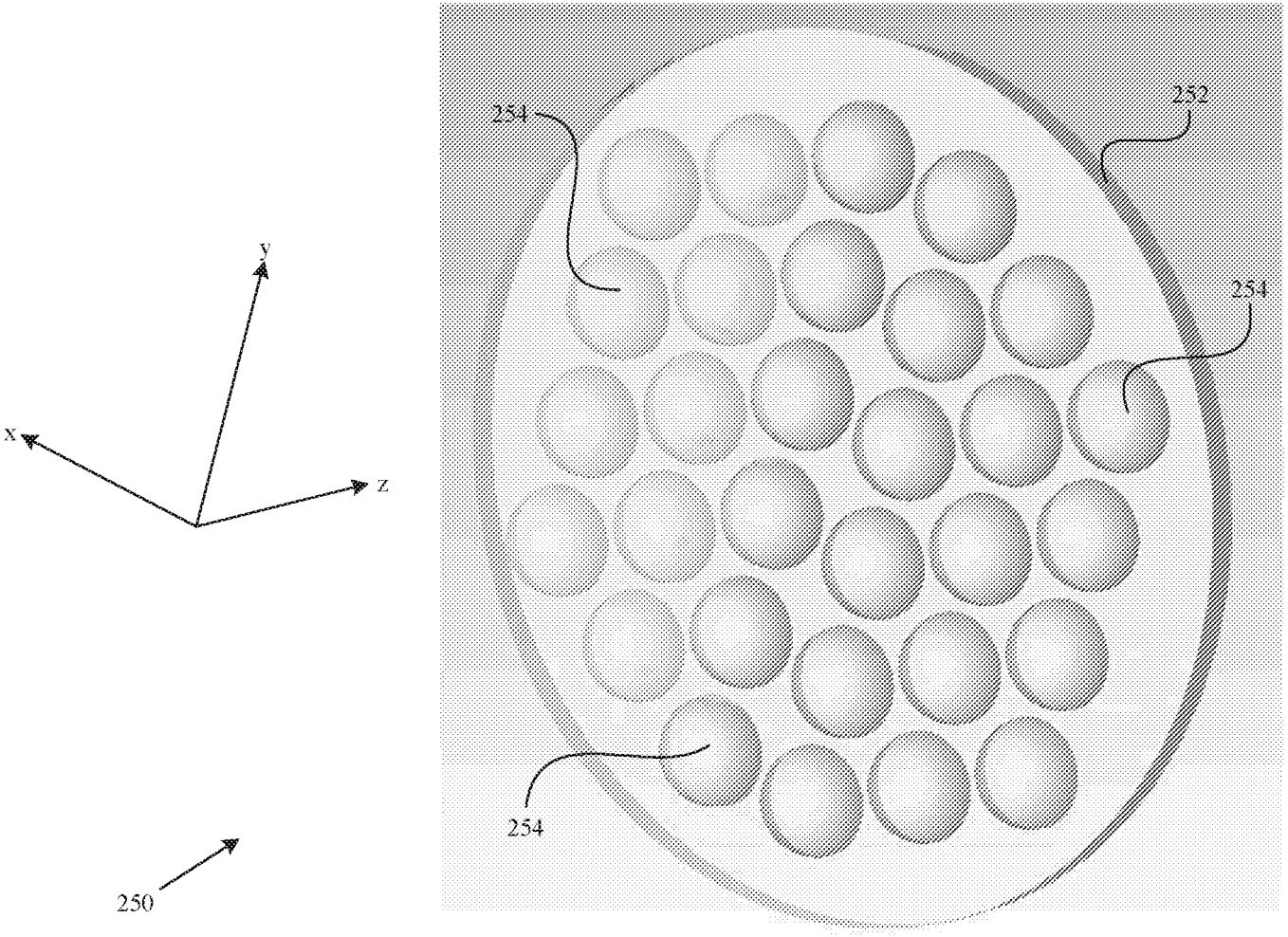
FIG. 10A is a perspective illustration of a multi-point lens structure in accordance with a non-limiting representative embodiment of the present disclosure.

As indicated above, in various embodiments optical energy output by the set of illumination sources 200 is coupled into portions of the target volume of tertiary explosive medium 150 by way of at least one lens, lens structure, lens assembly, or lens array 250. FIG. 10A is a perspective illustration of a multi-point lens structure 250 in accordance with a non-limiting representative embodiment of the present disclosure, one or more of which can be used for delivering optical energy to the target volume of tertiary explosive medium 150 in a manner that facilitates initiating, generating a DDT in, or detonating the target volume of tertiary explosive medium 150. More particularly, in an embodiment multi-point lens structure 250 includes a base lens element 252 such as a cylindrical lens, which has an array of additional lens elements 254 formed thereon and/or therein. The individual lens elements 254 can include or be, for instance, half ball lenses having a radius of approximately 0.5 mm, which can be formed or attached to the base lens element 252 in a conventional manner. In other embodiments, one or more portions of a lens structure 250 can include additional or other types of optical structures formed thereon and/or therein (e.g., microlens elements), depending upon embodiment details.

Figure 10B:
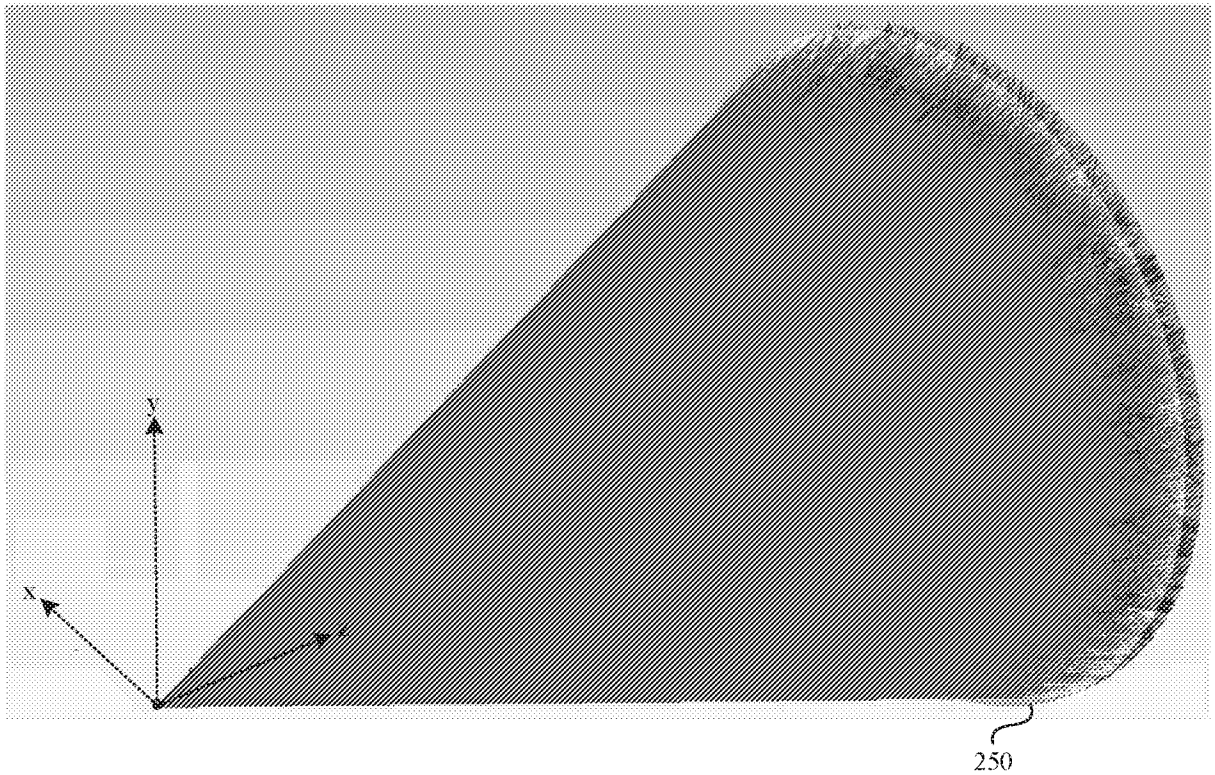
FIG. 10B is a representative ray trace plot of illumination output by a laser incident upon the multi-point lens structure of FIG. 10A.
Figure 10C:
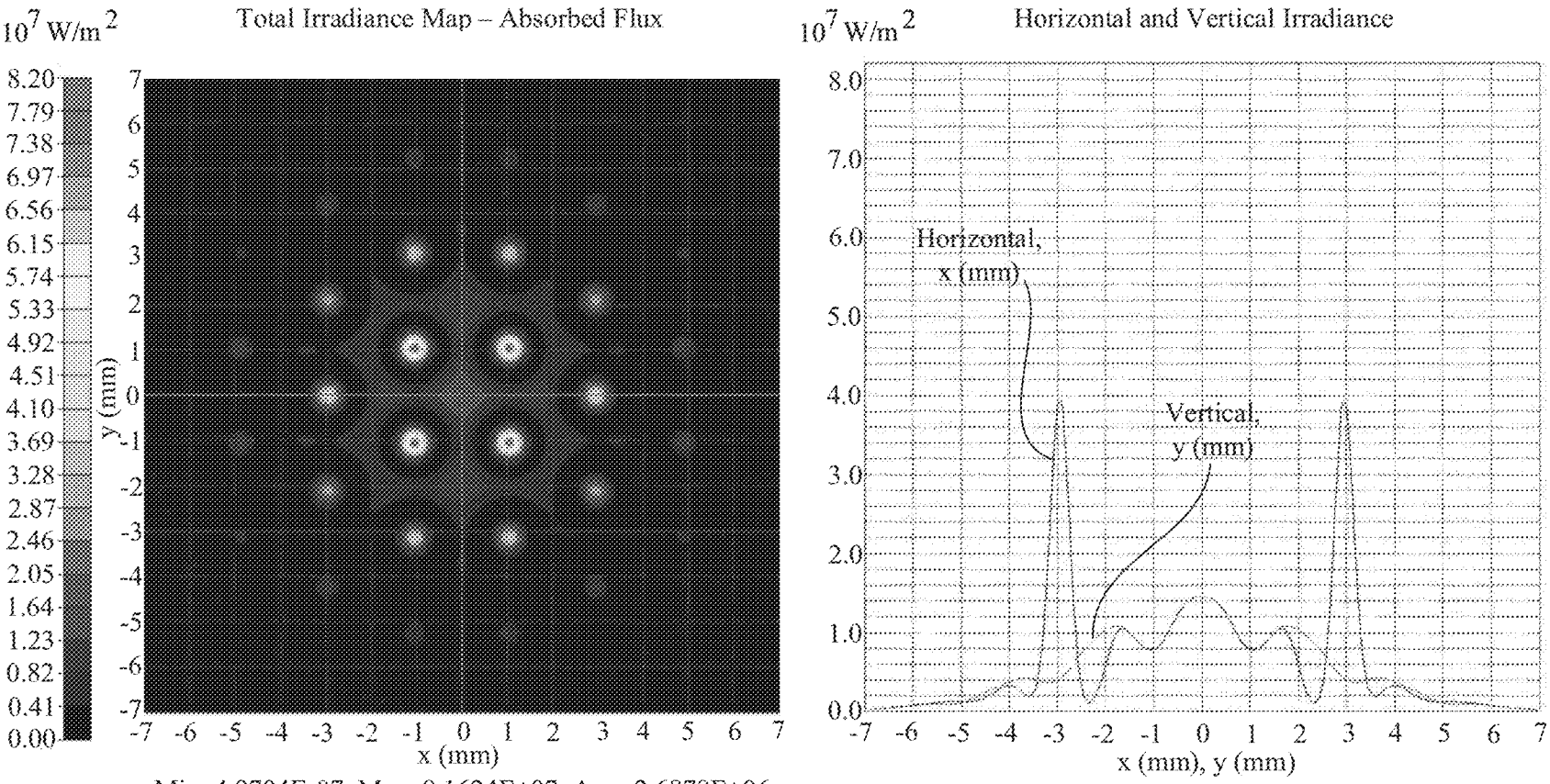
FIG. 10C is a numerically generated (x, y) irradiance map of the multi-point lens corresponding to the ray trace plot of FIG. 10B.

FIG. 10B is a representative ray trace plot of illumination output by a laser 200 incident upon the multi-point lens structure 250 of FIG. 10A; and FIG. 10C is a numerically generated (x, y) irradiance map of the multi-point lens 250 corresponding to this ray trace plot. In several embodiments, the irradiance through multiple lens elements 254, and particularly x axis lens elements 254 between approximately −3 and +3 mm and y axis lens elements 254 between approximately −2 and +2 mm, can be sufficient for the initiation, generation of a DDT in, or detonation of the target volume of tertiary explosive medium 100.

Particular Representative Optical Initiation and/or Detonation Systems

Figure 11C:
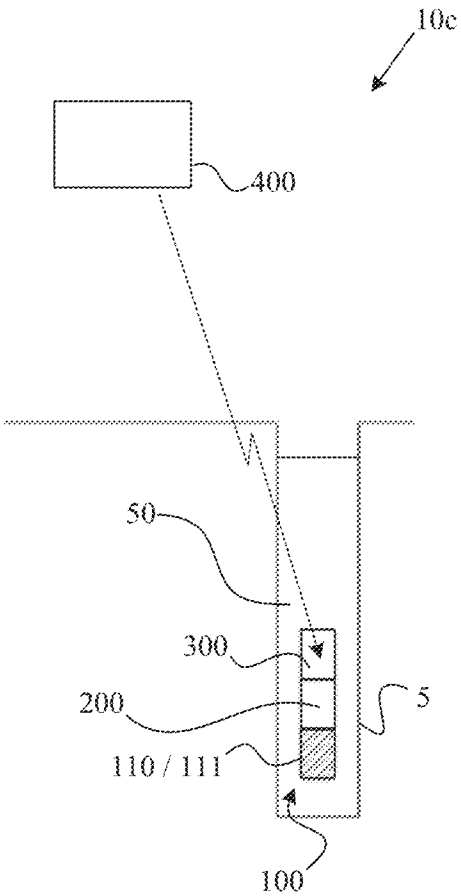
FIGS. 11A-11C are block diagrams showing particular representative embodiments of initiation and/or detonation systems c in accordance with an embodiment of the present disclosure.
Figure 11B:
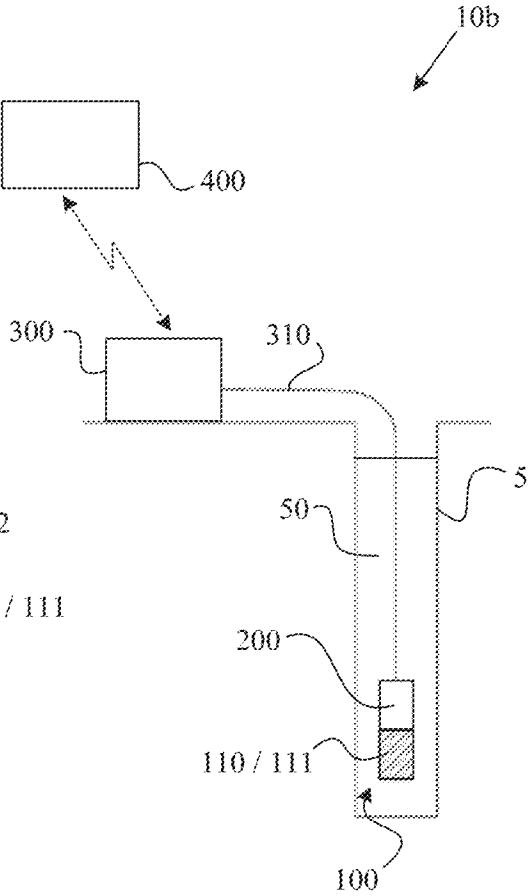
Figure 11A:
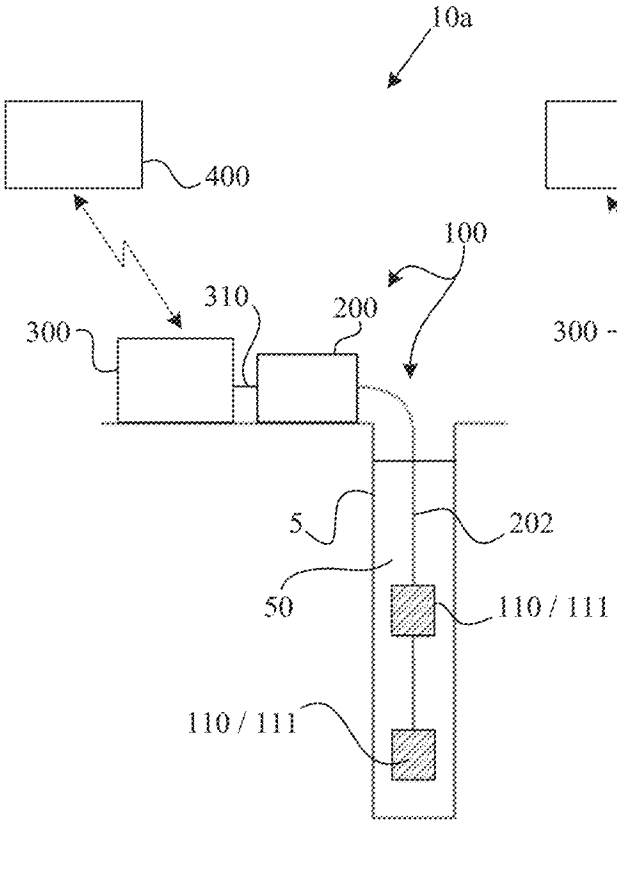

FIGS. 11A-11C are block diagrams showing particular representative embodiments of initiation and/or detonation systems 10*a-c* in accordance with an embodiment of the present disclosure. For purpose of brevity and clarity, each of these embodiments 10*a-c* is directed to the initiation or detonation of a volume of tertiary explosive medium contained in one or more optical initiation or detonation device 100 while residing in one or more boreholes or blastholes 5. Notwithstanding FIGS. 11A-11C, embodiments in accordance with the present disclosure are not limited to applications or environments in which 100 boreholes are present.

As indicated in FIGS. 11A-11C, a system 10*a-c* in accordance with an embodiment of the present disclosure includes at least optical initiation or detonation device 100 is configured for receiving optical energy output by a set of illumination sources 200 and explosively initiating or detonating in response to such optical energy. Each such device 100 includes a body structure 110 or shell structure 111 in which one or more volumes or target volumes of explosive media, e.g., tertiary explosive media, reside, e.g., in a manner set forth herein. The set of optical illumination sources 200 can include one or more devices or structures (e.g., beam shaping and/or (re)directing elements, such as lens structures, beam splitters, and/or mirrors) for effectively or efficiently coupling optical energy into such volumes of explosive media to achieve the initiation thereof.

Depending upon embodiment and/or situational details, a given borehole 5 can include multiple optical initiation or detonation devices 100, such as a first optical initiation or detonation device 100*a* and a second optical initiation or detonation device 100*b*, in a manner readily understood by individuals having ordinary skill in the relevant art.

Each system 10*a-c* also includes a local power, communication, and control unit 300 (hereafter local control unit 300) configured for managing and controlling the operation of the set of illumination sources 200, and which is thus configured for electromagnetic signal communication therewith. Each system 10*a-c* additionally includes a master control system or unit 400 configured for remotely controlling the operation of the local control unit 300 by way of electromagnetic signal communication therewith. Electromagnetic signal communication can involve one or more of wireless electrical signal transfer, wire-based electrical signal transfer, magnetic induction based signal transfer, optical fibre based optical signal transfer, and free space based optical signal transfer in accordance with embodiment details, as individuals having ordinary skill in the relevant art will readily appreciate. In the embodiments shown in FIGS. 11A and 11B, the local control unit 300 is coupled to the set of illumination sources 200 by way of a wire-based link or cable 310.

Depending upon embodiment details, certain portions of a system 10*a-c* can reside external or internal to the borehole 5. For instance, in the embodiment such as that shown in FIG. 2A, the set of illumination sources 200 and the local control unit 300 reside external to the borehole 5, and optical energy is deliverable or delivered to the first and second optical initiation or detonation devices 100*a-b* by way of an optical fibre, fibre bundle, or light guide 202. In the embodiment shown in FIG. 2B, the set of illumination sources 200 resides within the borehole 5 (e.g., the set of illumination sources is couplable or coupled to the body structure 110 or shell structure 111), whereas the local control unit 300 resides external to the borehole 5. In the embodiment shown in FIG. 11C, the set of illumination sources 200 and the local control unit 300 reside internal to the borehole 5. In such an embodiment, communication between the master control system 400 and the local control unit 300 can occur by way of wireless electronic (e.g., radio frequency (RF) based) signal communication and/or magnetic induction based signal communication.

The borehole 5 also typically contains at least one additional or other volume of tertiary explosive medium 50 therein, to which optical energy is not applied by the set of illumination sources 200, but which can be initiated or detonated in response to the initiation, generation of a DDT in, or detonation of one or more volumes of explosive media contained in one or more optical initiation or detonation devices positioned in the borehole 5, in a manner that individuals having ordinary skill in the relevant art will readily comprehend. Depending upon embodiment and/or situational details (e.g., rock formation characteristics, and/or the location(s) or characteristics of one or more mineral bodies within the rock formation), one optical initiation or detonation device 100 and its corresponding additional volume of tertiary explosive medium 50 can be contiguous with or physically separated from (e.g., by way of decking material(s)) another optical initiation or detonation device 100 and its corresponding additional volume of tertiary explosive medium 50, as individuals having ordinary skill in the relevant art will clearly recognize.

The above description details aspects of multiple systems, subsystems, apparatuses, devices, techniques, processes, and/or procedures in accordance with particular non-limiting representative embodiments of the present disclosure. It will be readily understood by a person having ordinary skill in the relevant art that modifications can be made to one or more aspects or portions of these and related embodiments without departing from the scope of the present disclosure, which is limited only by the following claims.

The invention claimed is:

1. A photoinitiation apparatus configured for photoinitiating an explosive medium carried thereby, the photoinitiation apparatus comprising:

a set of illumination sources or elements coupled to a power source, the set of illumination sources or elements configured to output electromagnetic energy having at least one wavelength within or between ultraviolet (UV) and infrared (IR) portions of the electromagnetic spectrum; and a body structure that internally carries at least one explosive medium, and which provides a confinement structure for the at least one explosive medium carried thereby, wherein the body structure (i) excludes each of a primary explosive composition and a secondary explosive composition and (ii) confines at least a first volume of tertiary explosive in a first portion of the body structure, wherein the first volume of tertiary explosive in the first portion of the body structure (i) is photonically coupled to the set of illumination sources or elements, and (ii) contains a photoexcitation transfer agent or a photothermal absorber comprising bitumen, crude oil, gilsonite, bunker oil, or coal dust, wherein the body structure is configured for each of (a) residing in a borehole that has been loaded with a column of an additional or adjunctive tertiary explosive medium that resides external to the body structure, and (b) coupling a detonation front into the column of additional or adjunctive tertiary explosive medium to detonate the additional or adjunctive tertiary explosives medium.

2. The photoinitiation apparatus of claim 1, wherein each initiation apparatus comprises a second volume of tertiary explosive medium in a second portion of the body structure, wherein the first volume of tertiary explosive medium does not completely overlap with a spatial extent of the second volume of tertiary explosive medium.

3. The photoinitiation apparatus of claim 2, wherein each of the first volume of tertiary explosive medium and the second volume of tertiary explosive medium comprises a fuel or fuel phase and an oxidizer salt.

4. The photoinitiation apparatus of claim 2, wherein the body structure further comprises an intermediate body structure portion disposed between the first body structure portion and the second body structure portion and confining an intermediate volume of explosive medium, the intermediate volume of explosive medium comprising a liquid explosive medium, a gel-based explosive medium, a binary explosive medium, or a peroxide-based explosive medium.

5. The photoinitiation apparatus of 2, wherein each of the first volume of tertiary explosive medium and the second volume of tertiary explosive medium comprises an ammonium nitrate (AN) based emulsion explosive medium.

6. The photoinitiation apparatus of 4, wherein the intermediate volume of explosive medium comprises one of nitromethane, nitroethane, nitropropane and hydrogen peroxide.

* * * * *